US006147651A

United States Patent [19]

Yamazaki et al.

[11] Patent Number: 6,147,651

[45] Date of Patent: Nov. 14, 2000

[54] ANTENNA SYSTEM

[75] Inventors: Masazumi Yamazaki, Kamakura; Kouichi Ogawa, Hirakata; Yoshio Koyanagi, Ebina, all of Japan

[73] Assignee: Matsushita Electric Industrial Co., Ltd., Osaka, Japan

[21] Appl. No.: 09/068,407

[22] PCT Filed: Sep. 11, 1997

[86] PCT No.: PCT/JP97/03214

§ 371 Date: Aug. 6, 1998

§ 102(e) Date: Aug. 6, 1998

[87] PCT Pub. No.: WO98/11625

PCT Pub. Date: Mar. 19, 1998

[30] Foreign Application Priority Data

Sep. 11, 1996 [JP] Japan ..... 8-261220
Oct. 23, 1996 [JP] Japan ..... 8-297870

[51] Int. Cl.[7] ..... H01Q 1/24

[52] U.S. Cl. ..... 343/702; 343/895

[58] Field of Search ..... 343/833, 834, 343/702, 836, 700 MS

[56] References Cited

FOREIGN PATENT DOCUMENTS

| | | |
|---|---|---|
| 1-204504 | 8/1989 | Japan . |
| 5-22011 | 1/1993 | Japan . |
| 7-226624 | 8/1995 | Japan . |
| 8-307121 | 11/1996 | Japan . |

*Primary Examiner*—Don Wong
*Assistant Examiner*—James Clinger
*Attorney, Agent, or Firm*—Pollock, Vande Sande & Amernick

[57] ABSTRACT

The present invention provides an antenna system, which is used for a mobile wireless device and can be accommodated in or withdrawn from a telephone set main unit, whereby element length is shortened and strength is increased while avoiding deterioration of characteristics when the antenna is accommodated in the telephone set main unit. The antenna (40) comprises a helical antenna (41) having a feeding unit (42) and a whip antenna (43) having a feeding unit (44). The whip antenna (43) passes through the helical antenna (41), and the helical antenna (41) and the whip antenna (43) are electrically insulated from each other. Because the whip antenna (43) is designed to pass through the helical antenna (41), an antenna system for mobile wireless communication can be provided, in which element length is shortened and strength is increased.

10 Claims, 23 Drawing Sheets

ANTENNA SYSTEM

FIELD OF THE INVENTION

The present invention relates to an antenna system used primarily in a mobile wireless device, and in particular, to an antenna system, by which it is possible to shorten element length and to increase strength of the antenna system.

BACKGROUND ART

In recent years, there have been increasing demands on mobile wireless or radio devices such as portable telephone sets. As a conventional type antenna for portable telephone, a whip antenna is often used, which can be located in a portable telephone main unit.

As an example, FIG. 33 and FIG. 34 each represents an arrangement of a conventional type antenna system as disclosed, for example, in JP-A-1-204504. In the figures, symbols and component names described in JP-A-1-204504 are used. As shown in FIG. 33, when an antenna element 14 is withdrawn from a portable telephone main unit 10, a contact member 15 comes into contact with an upper contact piece 21*a*. As a result, the antenna element 14 is connected to a matching circuit assembly 12.

As shown in FIG. 34, when the antenna element 14 is located in the portable telephone main unit 10, a contact member 16 is brought into contact with a lower contact piece 21*b*. As a result, the antenna element 14 is connected to the matching circuit assembly 12. Thus, the antenna element 14 is connected to the matching circuit assembly 12, not only when it is withdrawn from the portable telephone main unit 10 but also when it is located in it.

In the above arrangement, it is supposed that, when the antenna element 14 is withdrawn from the portable telephone main unit 10, impedance is Z1 when the antenna element 14 is seen from the matching circuit assembly 12 and impedance is Z2 when the antenna element 14 is seen from the matching circuit assembly 12 with the antenna element 14 located in the portable telephone main unit 10. If element length of the antenna element 14, position of feeding point, and dimensions of wireless device housing are adjusted in such a manner that Z1 and Z2 become equal to each other, satisfactory matching condition can be attained by the matching circuit assembly 12 in both cases, i.e. in case the antenna element 14 is withdrawn from the portable telephone main unit 10 or in case it is located in the portable telephone main unit 10. As a result, mobile communication with high quality and stability can be achieved.

The conventional system is disadvantageous in that, when the antenna element 14 is located in the portable telephone main unit 10, a part of radiation energy is absorbed by the telephone main unit or to the body of a person who carries the telephone, and the characteristics of the antenna are deteriorated.

As one of the measures to solve this problem, a separate type helical-whip antenna is often used, in which the antenna is separated to two types of antenna, i.e. to a helical antenna operated when the antenna is located in the portable telephone main unit and a whip antenna operated when the antenna is withdrawn from the portable telephone main unit. FIG. 35A to FIG. 35C each represents an arrangement example of such an antenna system. FIG. 35A shows an entire arrangement of a separate type helical-whip antenna, and FIG. 35B and FIG. 35C show respectively the condition when the antenna 30 is located in the telephone main unit 38 and the condition when the antenna 30 is withdrawn from the telephone main unit 38.

As shown in FIG. 35B, when the antenna 30 is located in the telephone main unit 38, a helical antenna 31 is connected to a connection terminal 37 leading to a radio circuit via a feeding unit 32, a connection member 35, and a matching circuit 36. In this case, a whip antenna 33 located in the telephone main unit is separated from the radio circuit, and no influence is exerted on the radio circuit from the telephone set around the whip antenna the body of a person who carries the telephone.

As shown in FIG. 35C, when the antenna 30 is withdrawn from the telephone main unit 38, the whip antenna 33 is connected to the connection terminal 37 leading to the radio circuit via a feeding unit 34, the connection member 35, and the matching circuit 36. By adopting such an arrangement, it is possible to separate the antenna to two types, i.e. to an antenna operated when it is located in the telephone main unit and to an antenna to be operated when it is withdrawn from the telephone main unit, and deterioration of the characteristics of the antenna when the antenna is located in the telephone main unit can be avoided.

However, there are problems in that element length of the antenna 30 is increased by the helical antenna 31 and that strength of the connecting point of the helical antenna 31 and the whip antenna 33 is weakened. In the conventional type antenna, impedance is determined by equivalent electrical length such as element length of the antenna element or dimensions of the radio circuit housing. Accordingly, it is disadvantageous in that the desired impedance and external design of the radio circuit are not necessarily compatible with each other.

Further, with the diversification of the mobile communication system, frequency band used is also diversified, e.g. 800 MHz band, 1.5 GHz band, and 1.9 GHz band, and there are strong demands on the development of a radio circuit, which can be used for different frequency bands. The conventional type antenna system can cope with only one frequency band, and if it is used for a wireless device for two or more different systems, characteristics are extremely deteriorated.

DISCLOSURE OF THE INVENTION

To solve the above problems, it is an object of the present invention to provide an antenna system, by which it is possible to shorten element length and to increase the strength compared with a separate type helical-whip antenna while avoiding deterioration of characteristics when the antenna is located in the device, to independently control impedance of the whip antenna in two frequency bands, to obtain the desired impedance regardless of external design of the wireless device, to attain a satisfactory matching condition, and to achieve mobile communication with high quality and stability.

In the antenna system of the present invention, a helical antenna to be operated when the antenna is located in the wireless device main unit and a whip antenna to be operated when the antenna is withdrawn from the radio circuit main unit are electrically insulated from each other, and the whip antenna is designed to pass through the helical antenna.

According to the present invention, it is possible to shorten element length of the antenna system and to increase the strength. The antenna system of the present invention comprises an antenna element connected to a radio circuit having a first frequency band, and a first parasitic or passive element, whereby said first parasitic element is arranged closely with a very small spacing to said antenna element with respect to wavelength of said first frequency band, and real equivalent electrical length of said first parasitic element in said first frequency band is not ½ wavelength or its integral multiple and is terminated by a first terminating circuit comprising a reactance element. Thus, it is possible to provide an effect to control impedance of the antenna element without changing the element length of the antenna element.

The invention described in provides an antenna system, wherein said antenna element is connected to a radio circuit having said first frequency band and a second frequency band, said first parasitic element is arranged closely with a very small spacing to said antenna element with respect to wavelength in said first frequency band and said second frequency band, and real equivalent electrical length of said first parasitic element in said second frequency band is ½ wavelength or its integral multiple. It is possible to provide an effect to independently control impedance in the first frequency band without influencing impedance in the second frequency band of the antenna element.

The invention further provides an antenna system, wherein there is provided a second parasitic element, whereby said second parasitic element is arranged closely with a very small spacing to said antenna element and said first parasitic element with respect to wavelength in said first frequency band and said second frequency band, real equivalent electrical length of said second parasitic element in said first frequency band is ½ wavelength or its integral multiple, real equivalent electrical length of said second parasitic element in said second frequency band is not ½ wavelength or its integral multiple, and said second parasitic element is terminated by a second terminating circuit comprising a reactance element. It is thereby possible to independently control impedance in the first frequency band of the antenna element and impedance in the second frequency band without influencing one another.

The invention further provides an antenna system, wherein said first terminating circuit is provided with a function to discretely or continuously control the impedance. It is thereby possible to more precisely control impedance of the antenna element.

The invention described in claim 5 provides an antenna system, wherein said first terminating circuit is provided with a function to discretely or continuously control the impedance. It is thereby possible to more precisely and independently control impedance in the first frequency band without giving influencing on impedance in the second frequency band of the antenna element.

The invention further provides an antenna system, wherein at least one of said first terminating circuit or said second terminating circuit is provided with a function to discretely or continuously control the impedance. It is thereby possible to more precisely and independently control impedance in the first frequency band of the antenna element and impedance in the second frequency band without either influencing the other.

The antenna system further comprises a helical antenna to be operated when an antenna is located in a radio circuit main unit, and a whip antenna to be operated when the antenna is withdrawn from the radio circuit main unit, whereby said helical antenna and said whip antenna are electrically insulated from each other, and said whip antenna is designed to pass through said helical antenna. By adopting such an arrangement, it is possible to shorten the element length and to increase the strength of the antenna system while electrically insulating the helical antenna and the whip antenna from each other.

The invention further provides an antenna, wherein said helical antenna has a connecting unit to be connected to a radio circuit circuit when the antenna is located in the wireless device main unit, said whip antenna is arranged closely to said connecting unit and has a first connecting unit to be connected to a ground plane when the antenna is located in the radio circuit main unit and a second connecting unit to be connected to the radio circuit when the antenna is withdrawn from the main unit. By adopting such an arrangement, it is possible to avoid deterioration of characteristics when the antenna system is accommodated in the radio circuit main unit.

The invention further provides an antenna system, wherein there is provided a parasitic element arranged closely with a very small spacing to said whip antenna with respect to wavelength of the frequency band applied, and said parasitic element has a connecting unit to be connected to a ground plane via a circuit network comprising a reactance element when said whip antenna is withdrawn from the radio circuit main unit. It is possible to control impedance of the whip antenna without changing element length of the whip antenna.

The invention further provides an antenna system, wherein said helical antenna and said whip antenna are connected to a radio circuit having a first frequency band and a second frequency band applied, said parasitic element is arranged closely with a very small spacing to said whip antenna with respect to wavelength in said first frequency band and said second frequency band, real equivalent electrical length of said parasitic element in said first frequency band is not ½ wavelength or its integral multiple, and real equivalent electrical length of said parasitic element in said second frequency band is ½ wavelength or its integral multiple. By adopting such an arrangement, it is possible to independently control impedance in the first frequency band without exerting influence on impedance in the second frequency band in the whip antenna.

The invention further provides an antenna, wherein there is further provided a second parasitic element, said second parasitic element is arranged closely with a very small spacing to said whip antenna and said first parasitic element with respect to wavelength of said first frequency band and said second frequency band, real equivalent electrical length of said second parasitic element in said first frequency band is ½ wavelength or its integral multiple, and real equivalent electrical length of said second parasitic element in said second frequency band is not ½ wavelength or its integral multiple, and said second parasitic element is connected to a connecting unit via a circuit network comprising a reactance element. By adopting such an arrangement, it is possible to independently control impedance in the first frequency band and impedance in the second frequency band without exerting influence on each other.

BEST MODE FOR CARRYING OUT THE INVENTION

In the following, description will be given on the best mode of the present invention referring to FIGS. 1 to 32.

(1st Embodiment)

Description will be given now on an antenna system of a first embodiment of the present invention referring to FIGS. 1 to 5.

Figure 1:
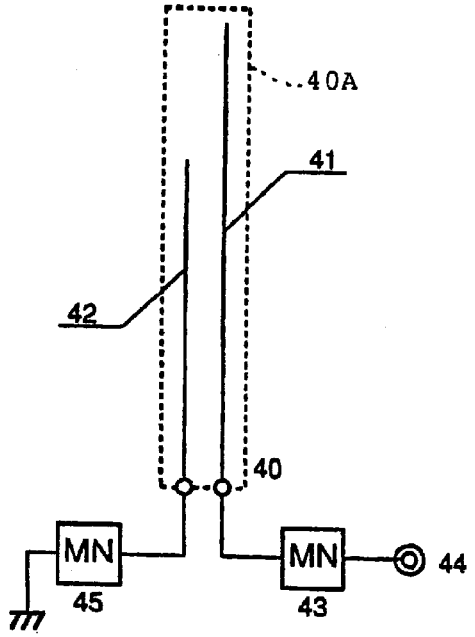
FIG. 1 is a block diagram showing an arrangement of an antenna system of a first embodiment of the present invention.

FIG. 1 shows an arrangement of an antenna system of a first embodiment of the present invention, in which the antenna system of the first embodiment of the present invention is applied to a whip antenna.

A whip antenna 40 comprises an antenna element 41 and a (first) parasitic element 42. The antenna element 41 and the parasitic element 42 are held within a casing 40A made of synthetic resin (shown by dotted line). Instead of the casing 40A, these elements can be arranged in a tube or on a printed board. Here, the antenna element 41 is connected to a connection terminal 44 leading to a radio circuit operated in a (first) frequency band A via a matching circuit 43. The matching circuit 43 possesses impedance converting characteristics for converting impedance of the antenna element 41 to impedance of a radio circuit connected to the connection terminal 44 in the frequency band A. The matching circuit 43 may comprise lumped constant elements such as inductor, capacitor, etc. or distributed constant elements such as strip line.

The parasitic element 42 has real equivalent electrical length of ½ wavelength or its integral multiple in the frequency band A and terminated by a (first) terminating circuit 45 comprising a reactance element. The terminating circuit may comprise lumped constant elements such as inductor, capacitor, etc. or distributed constant elements such as strip line. Because the terminating circuit 45 has an arrangement similar to that of the matching circuit 43, these two circuits are referred by the same symbol MN.

Figure 2:
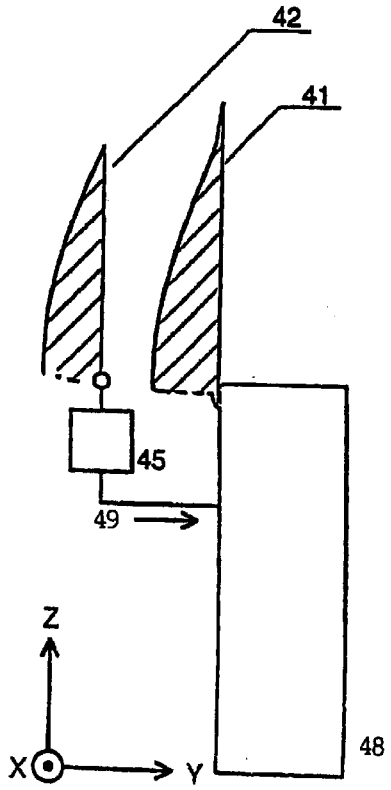
FIG. 2 is a drawing to explain operation of the antenna system of the first embodiment of the invention.

FIG. 2 is a drawing to explain operation of the antenna system of the first embodiment of the present invention and represents current distribution on the antenna element 41 and the parasitic element 42 when high frequency electric power of the frequency band A is supplied to the antenna element 41. The same component as in FIG. 1 is referred by the same symbol. Reference numeral 48 represents a metal plate simulating a housing of wireless device, and it is 129 mm and 32 mm in longitudinal and lateral dimensions respectively. The antenna element 41 has element length of 95 mm and the parasitic element 42 has element length of 79 mm. Both are made of metal wire of 0.5 mm in diameter, and these are arranged with a spacing of 1 mm. Center frequency fA of the frequency band A is set to 948 MHz. Expansion on the shaded portion indicates value of electric current on element of the antenna element 41 of the parasitic element 42.

A part of the high frequency power of the frequency band A supplied to the antenna element 41 is induced on the parasitic element 42. Because the real equivalent electrical length of the parasitic element 42 with respect to the frequency band A is about ¼ wavelength, current distribution at the connecting point of the parasitic element 42 and the terminating circuit 45 reaches maximum, and high frequency current 49 flows to the radio circuit housing 48 via the terminating circuit 45.

The high frequency current 49 flowing to the radio circuit housing 48 exerts influence on impedance of the antenna element 41. Because amplitude and phase of the high frequency current 49 can be controlled by impedance of the terminating circuit 45, it is possible to indirectly control impedance of the antenna element 41 by controlling impedance of the terminating circuit 45.

Figure 3:
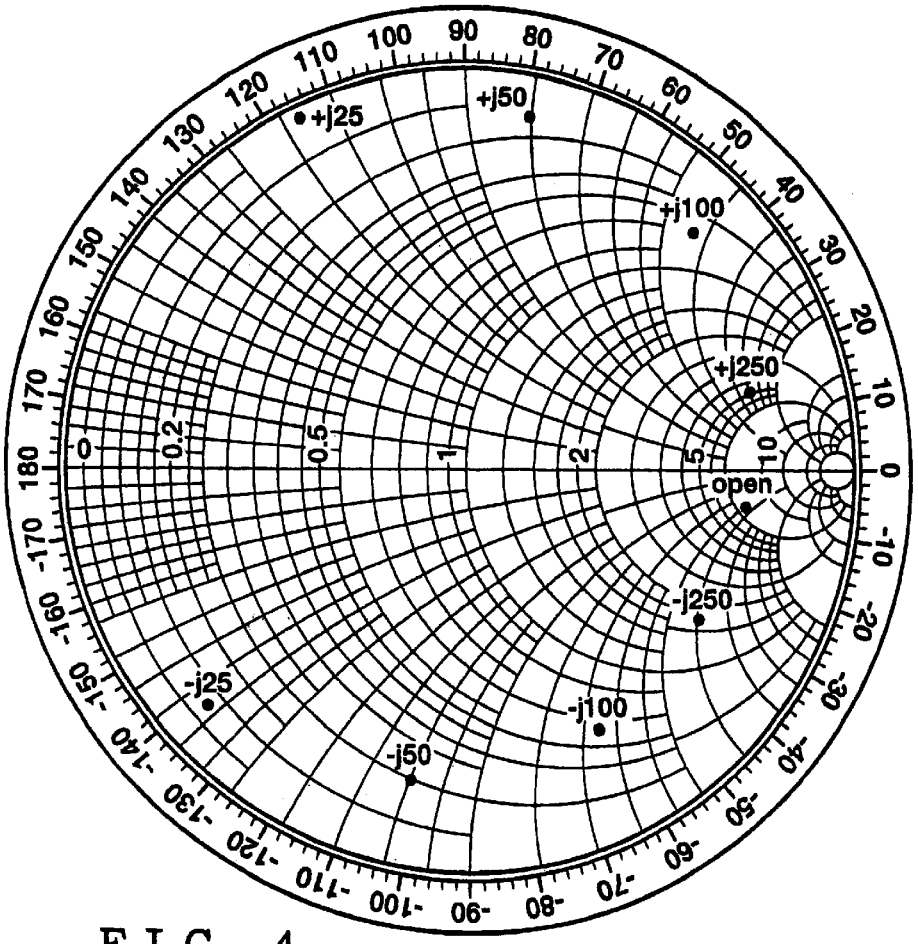
FIG. 3 represents a Smith chart to show impedance of the antenna system of the first embodiment of the present invention.

FIG. 3 is a drawing to explain operation of the antenna system of the first embodiment of the invention, and impedance of the antenna element 41 with respect to impedance of the terminating circuit 45 in the arrangement of FIG. 2 is shown on a Smith chart. In this chart, impedance of the terminating circuit 45 is changed from +j25 Ω via infinity to −j25 Ω. Markers shown by black circles each represents impedance of the antenna element 41 when fA=948 MHz (where fA represents center frequency of the frequency band A). By varying impedance of the terminating circuit 45 and by changing amplitude and phase of the high frequency current flowing to the housing 48 from the parasitic element 42, impedance can be controlled within wide range from inductive impedance to capacitive impedance.

Figure 4:
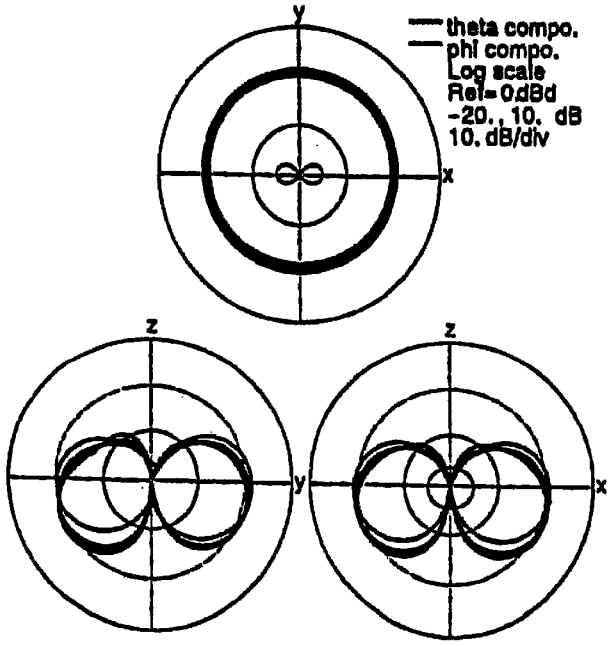
FIG. 4 represents radiation patterns of the antenna system of the first embodiment of the present invention.

FIG. 4 is a drawing to explain operation of the antenna system of the first embodiment of the invention, and it represents radiation patterns showing directional characteristics in the frequency band A with respect to impedance of the terminating circuit 45 in the arrangement of FIG. 2.

A radiation pattern diagram is a diagram showing directivity, which is one of the important characteristics of antenna. Using the position of the antenna as the origin of coordinates, the diagram shows how much energy is radiated in which direction by the antenna in each of planes XY, YZ and ZX. Here, impedance of the terminating circuit 45 is changed from +j25 Ω via infinity to −j25 Ω.

Radiation characteristics on the plane XY shows nondirectional characteristics as desirable for an antenna for a portable radio circuit. In general, by adding a parasitic element to an antenna element, it is possible to provide directional characteristics to the antenna, and this is known in examples such as the Uda-Yagi antenna. In the present invention, the spacing between the antenna element 41 and the parasitic element 42 is sufficiently short compared with the wavelength of the frequency band A, and non-directivity is achieved without adding the parasitic element 42.

In the radiation characteristics on the planes YZ and ZX, the radiation pattern is slightly changed by varying impedance of the terminating circuit 45. This is caused by variation of the high frequency current flowing to the radio circuit housing 48 depending on impedance of the terminating circuit 45.

However, the high frequency current 49 flowing from the parasitic element 42 via the terminating circuit 45 to the housing 48 exerts very little influence on radiation characteristics. Even when the impedance of the terminating circuit 45 is changed from +j25 Ω and impedance of the antenna element is controlled from +116° to −138° in phase, radiation patterns on the planes YZ and ZX can still maintain similarity.

Figure 5:
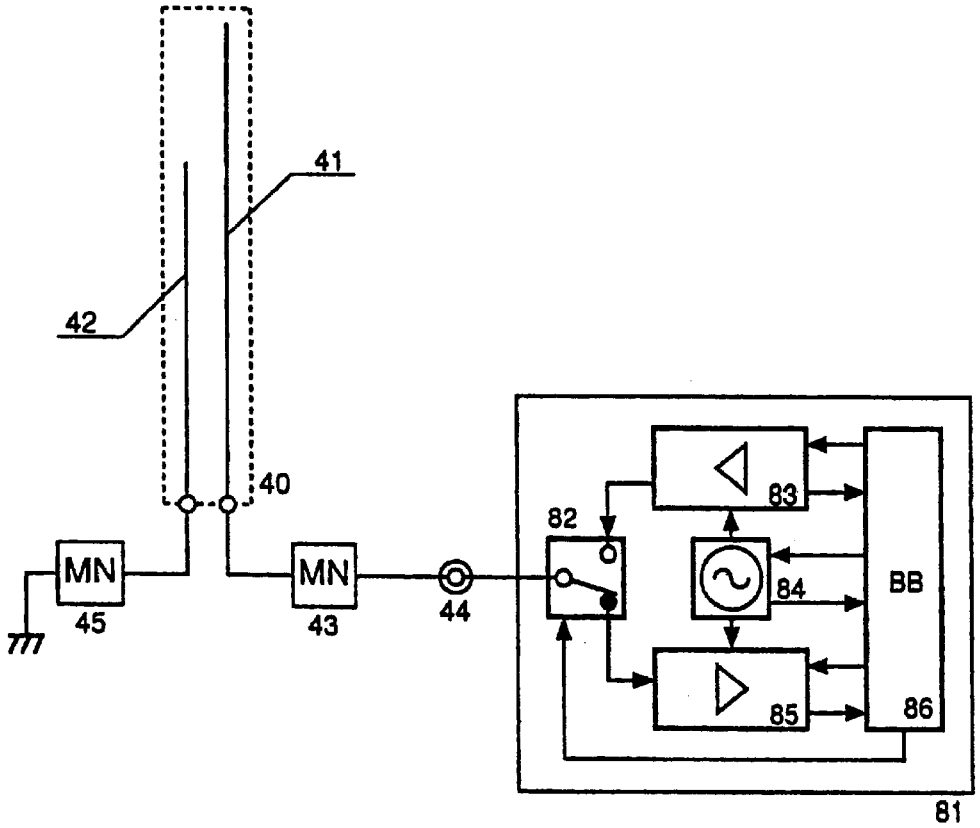
FIG. 5 is a block diagram showing an arrangement of a radio circuit, to which the antenna system of the first embodiment of the present invention is applied.

FIG. 5 is a block diagram showing an arrangement of a radio circuit, to which the antenna system of the first embodiment of the present invention is applied. The same component as in FIG. 1 is referred by the same symbol. Here, a circuit 81 comprises a switch 82, a transmitting circuit 83, an oscillation circuit 84, a receiving circuit 85, and a control circuit 86. In such an arrangement, impedance of the whip antenna can be controlled by adjusting the whip antenna length and the given dimension of the radio circit. As a result, satisfactory matching condition can be attained, and mobile communication of high quality and stability can be accomplished.

(2nd Embodiment)

Figure 6:
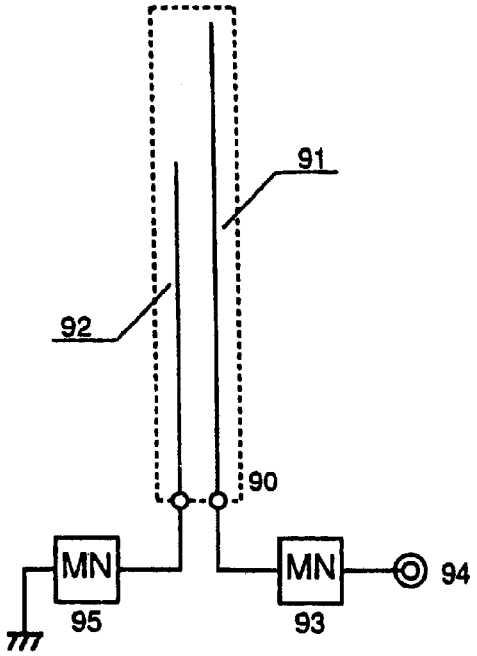
FIG. 6 is a block diagram showing an arrangement of an antenna system of a second embodiment of the present invention.

In the following, description will be given on an arrangement of an antenna system of a second embodiment of the present invention, referring to FIG. 6 to FIG. 10. FIG. 6 is a drawing to explain an arrangement of an antenna system of the second embodiment of the present invention, where the antenna system of the second embodiment of the present invention is applied to a whip antenna. In the description given below, it is supposed that center frequency of a first frequency band A is fA and center frequency of a second frequency band B is fB and that fA<fB, while description is also applicable when it is supposed that fA>fB.

A whip antenna 90 comprises an antenna element 91 and a (first) parasitic element 92. In this case, the antenna element 91 is connected via a matching circuit 93 to a connection terminal 94 leading to a radio circuit. On the other hand, the matching circuit 93 has double-humped characteristics to convert impedance of the antenna element 91 to a desired impedance in the first frequency band A and the second frequency band B.

The matching circuit 93 may comprise lumped constant elements such as inductor, capacitor, etc. or distributed constant elements such as strip line. The real equivalent electrical length of the parasitic element 92 in the first frequency band A is not ½ wavelength or its integral multiple, and real equivalent electrical length in the second frequency band B is ½ wavelength or its integral multiple, and it is terminated by a (first) terminating circuit 95, which comprises a reactance element.

Figure 7A:
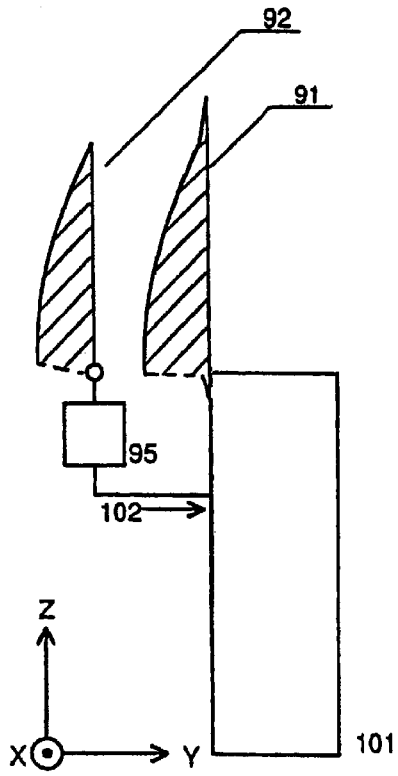
FIG. 7A and FIG. 7B each represents a drawing to explain operation of the antenna system of the second embodiment of the present invention.
Figure 7B:
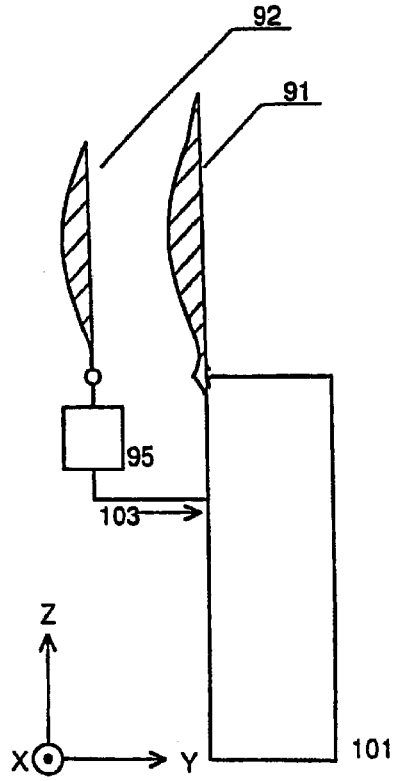

The terminating circuit 95 may comprise lumped constant elements such as inductor, capacitor, etc. or distributed constant elements such as strip line. FIG. 7A and FIG. 7B each represents a drawing to explain operation of the antenna system of the second embodiment of the present invention, showing current distribution of the antenna element 91 and the parasitic element 92 in the first frequency band A and the second frequency band B. The same component as in FIG. 6 is referred by the same symbol.

Here, reference numeral 101 represents a metal plate simulating a housing of a wireless device, and it is 129 mm in longitudinal dimension and 32 mm in lateral dimension. The antenna element 91 has element length of 95 mm, and the parasitic element 92 has element length of 79 mm. Both are made of metal wire of 0.5 mm in diameter and are arranged with a spacing of 1 mm. Center frequency fA of the first frequency band A is set to 948 MHz, and center frequency fB of the second frequency band B is set to 1907 MHz.

Expansion on the shaded portion indicates value of electric current on elements of the antenna element 91 and the parasitic element 92. FIG. 7A shows current distribution of the antenna element 91 and the parasitic element 92 when high frequency power of the first frequency band A is supplied to the antenna element 91.

A part of the high frequency power of the first frequency band B supplied to the antenna element 91 is induced on the parasitic element 92. Real equivalent electrical length of the parasitic element 92 is about ¼ wavelength with respect to the first frequency band A, and current distribution reaches a maximum at the connecting point of the parasitic element 92 and the terminating circuit 95, and the high frequency current 102 flows to the wireless device 101 via the terminating circuit 95. The high frequency current 102 flowing to the wireless device housing 101 exerts influence on the impedance of the antenna element 91. Because amplitude and phase of the high frequency current 102 can be controlled by impedance of the terminating circuit 95, it is possible to indirectly control impedance of the antenna element 91 by controlling the impedance of the terminating circuit 95.

Next, FIG. 7B shows current distribution of the antenna element 91 and the parasitic element 92 when high frequency power of the second frequency band B is supplied to the antenna element 91. Similarly to the description for FIG. 7A, a part of the high frequency power of the second frequency band B supplied to the antenna element 91 is induced on the parasitic element 92. With respect to the second frequency band B, real equivalent electrical length of the parasitic element 92 is about ½ wavelength, and the connecting point of the parasitic element 92 and the terminating circuit 95 is a node of current distribution. Thus, the value of the high frequency current 103 flowing to the wireless device housing 101 via the terminating circuit 95 is much reduced without depending upon the impedance of the terminating circuit 95. For this reason, the impedance of the parasitic element 92 in the second frequency band B is determined by element length of the antenna element 91 and by physical dimensions of the housing, and it is scarcely influenced by impedance of the terminating circuit 95.

Figure 8:
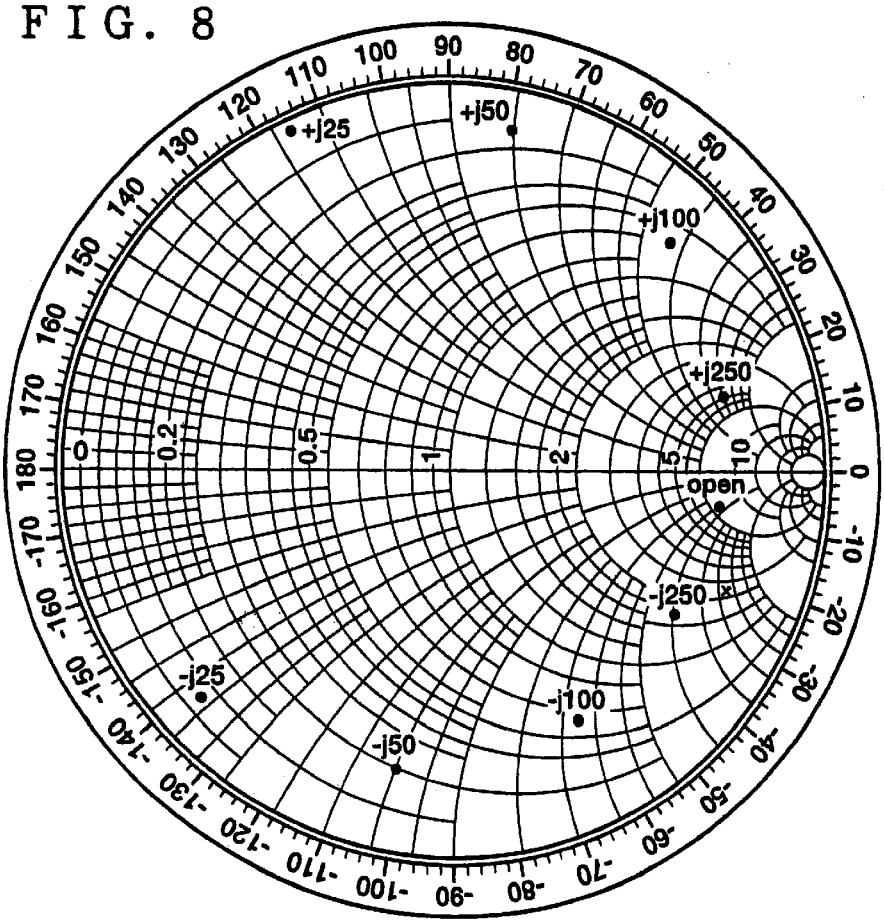
FIG. 8 shows a Smith chart showing impedance of the antenna system of the second embodiment of the present invention.

FIG. 8 is a diagram to explain operation of the antenna system of the second embodiment of the present invention, and it is a Smith chart showing impedance of the antenna element 91 with respect to impedance of the terminating circuit 95 in the arrangement of FIG. 7A and FIG. 7B. In this case, impedance of the terminating circuit 95 is changed from +j25 Ω via infinity to −j25 Ω.

Markers shown by black circles each represents impedance of the antenna element 91 when fA=948 MHz (where fA is center frequency in the first frequency band A). By changing impedance of the terminating circuit 95 and by varying amplitude and phase of the high frequency current flowing to the radio circuit housing 101 from the parasitic element 92, impedance can be controlled within a wide range from inductive impedance to capacitive impedance.

A marker shown by x indicates impedance of the antenna element 91 when fB=1907 MHz (where fB represents center frequency of the second frequency band B). In the second frequency band B, high frequency current does not flow almost at all from the parasitic element 92 to the radio circuit housing 101, and it does not depend upon impedance of the terminating circuit 95, and impedance of the antenna element 91 undergoes little change.

Figure 9A:
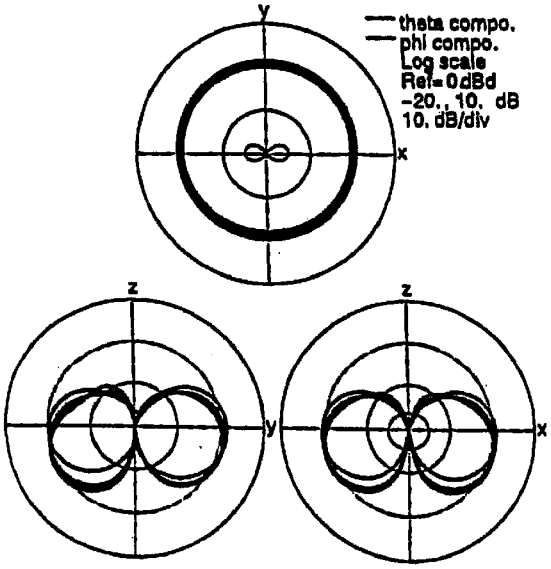
FIG. 9 represents radiation patterns of the antenna system of the second embodiment of the present invention.
Figure 9B:
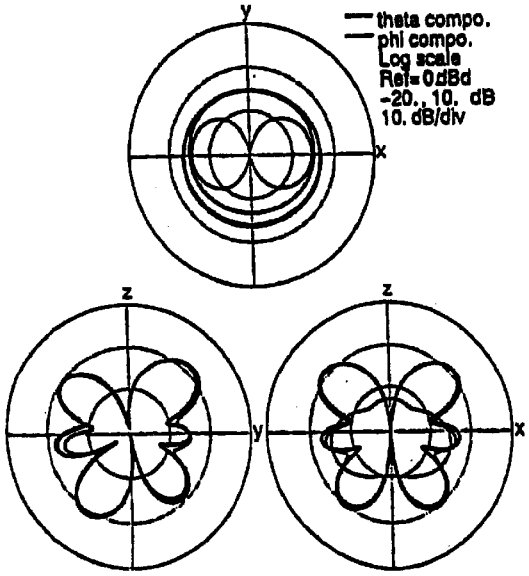

FIG. 9A and FIG. 9B each represents operation of the antenna system of the second embodiment of the present invention, and these are radiation pattern diagrams showing directional characteristics in the first frequency band A and the second frequency band B with respect to impedance of the terminating circuit 95 in the arrangement of FIG. 7. FIG. 9A shows characteristics in the first frequency band A, and FIG. 9B represents characteristics in the second frequency band B.

Impedance of the terminating circuit 95 is changed from +j25 Ω via infinity to −j25 Ω. Radiation characteristics on the plane XY shows non-directional characteristics desired for an antenna used for portable radio circuit in any of the bands. In radiation characteristics on the planes YZ and ZX, the radiation pattern is slightly varied by changing the impedance of the terminating circuit 95. This is caused by the fact that high frequency current flowing to the radio circuit housing 101 is varied by impedance of the terminating circuit 95.

However, the high frequency current 102 or 103 flowing from the parasitic element 92 via the terminating circuit 95 to the wireless device housing 101 gives little influence on radiation characteristics. When impedance of the terminating circuit 95 is changed from +j25 Ω via infinity to −j25 Ω in the first frequency band A and impedance of the antenna element 91 is controlled from +116° to −138° in phase, radiation patterns on the planes YZ and ZX can still maintain similar characteristics. The same applies to the second frequency band B.

Figure 10:
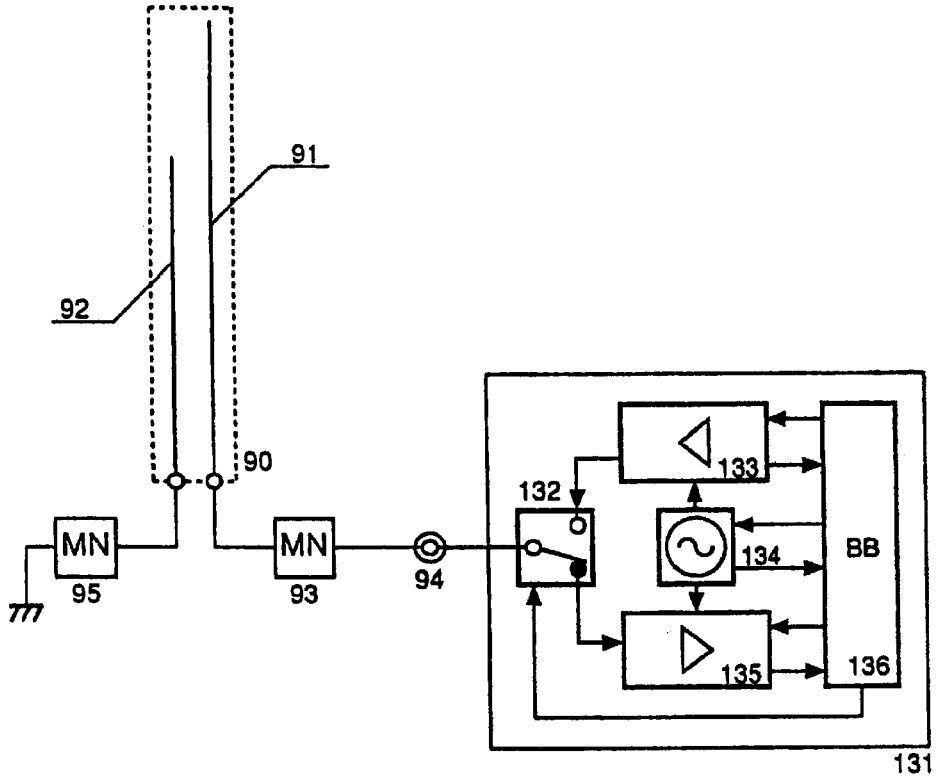
FIG. 10 is a block diagram showing an arrangement of a radio circuit, to which the antenna system of the second embodiment of the present invention is applied.

FIG. 10 is a block diagram showing an arrangement of a radio circuit, to which the antenna system of the second embodiment of the present invention is applied. The same component as in FIG. 6 is referred by the same symbol. A radio circuit circuit 131 is a radio circuit circuit in charge of the first frequency band A and the second frequency band B, and it comprises a switch 132, a transmitting circuit 133, an oscillation circuit 134, a receiving circuit 135, and a control circuit 136.

With the above arrangement, it is possible to control impedance of the first frequency band B independently from impedance of the second frequency band B. As a result, in any of the first frequency band A or the second frequency band B, satisfactory matching condition can be attained, and mobile communication with high quality and stability can be achieved.

(3rd Embodiment)

Figure 11:
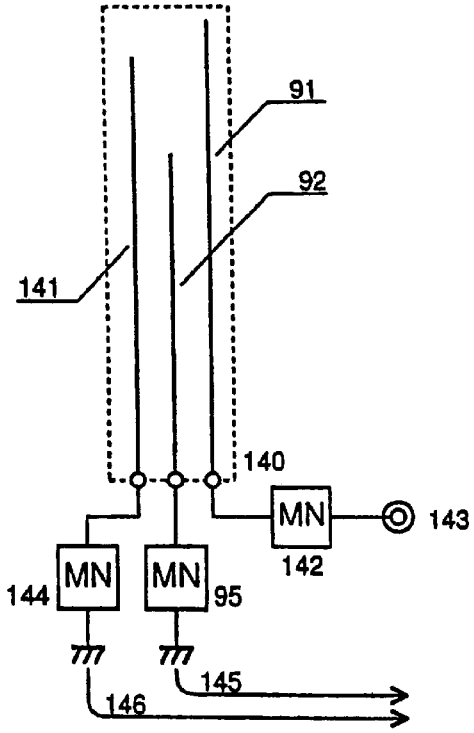
FIG. 11 is a block diagram showing an arrangement of an antenna system of a third embodiment of the present invention.

In the following, description will be given on an antenna system of a third embodiment of the present invention referring to FIG. 11 and FIG. 12. FIG. 11 is a block diagram showing an arrangement of the antenna system of the third embodiment of the invention when the antenna system of the third embodiment is applied to a whip antenna. The same component as in FIG. 6 is referred by the same symbol.

In the description given below, it is supposed that center frequency of the first frequency band A is fA and center frequency of the second frequency band B is fB and that fA<fB, while description is also applicable when it is supposed that fA>fB.

A whip antenna 140 comprises an antenna element 91, a first parasitic element 92, and a second parasitic element 141. Here, the antenna element 91 is connected to a connection terminal 143 leading to a radio circuit via a matching circuit 142. The matching circuit 142 has double-humped characteristics to convert impedance of the antenna element 91 to the desired impedance in the first frequency band A and the second frequency band B.

The matching circuit 142 may comprise lumped constant elements such as inductor, capacitor, etc. or distributed constant elements such as strip line. The second parasitic element 141 has real equivalent electrical length of ½ wavelength or its integral multiple in the first frequency band A, and its real equivalent electrical length in the second frequency band B is not ½ wavelength or its integral multiple, and it is terminated by a second terminating circuit, which has one end of the element opened and the other end comprising a reactance element.

The second terminating circuit 144 may comprise lumped constant elements such as inductor, capacitor, etc. or distributed constant elements such as strip line. In the above arrangement, high frequency current flowing from the first parasitic element 92 via the first terminating circuit 95 to the ground is referred by reference numeral 145, and high frequency current flowing from the second parasitic element 141 via the second terminating circuit 144 to the ground is referred by reference numeral 146.

A part of the high frequency power supplied to the antenna element 91 is induced on the first parasitic element 92 and the second parasitic element 141. In the first frequency band A, real equivalent electrical length of the first parasitic element 92 is different from ½ wavelength or its integral multiple. Thus, the connecting point of the first parasitic element 92 and the first terminating circuit 95 is not a node of current distribution, and high frequency current 145 flows via the first terminating circuit 95 to the ground.

On the other hand, real equivalent electrical length of the second parasitic element 141 is ½ wavelength or its integral multiple. Accordingly, the connecting point of the second parasitic element 141 and the second terminating circuit 144 is a node of current distribution, and the high frequency current 146 does not depend on impedance of the second terminating circuit 144 and does not flow almost at all. Impedance of the antenna element 91 undergoes influence from the high frequency current flowing to the ground. Because amplitude and phase of the high frequency current 145 can be controlled by impedance of the first terminating circuit 95, it is possible to indirectly control impedance of the first frequency band A of the antenna element 91 by controlling impedance of the first terminating circuit 95.

In the second frequency band B, real equivalent electrical length of the first parasitic element 92 is ½ wavelength or its integral multiple, and the connecting point of the first parasitic element 92 and the first terminating circuit 95 is a node of current distribution, and the high frequency current 145 does not depend on impedance of the first terminating circuit 95 and hardly flows.

On the other hand, real equivalent electrical length of the second parasitic element 141 is different from ½ wavelength or its integral multiple. Thus, the connecting point of the second parasitic element 141 and the second terminating circuit 144 is not a node of current distribution, and the high frequency current 146 flows to the ground via the second terminating circuit 144. Because amplitude and phase of the high frequency current 146 can be controlled by impedance of the second terminating circuit 144, it is possible to indirectly control impedance of the second frequency band B of the antenna element 91 by controlling impedance of the second terminating circuit 144.

Figure 12:
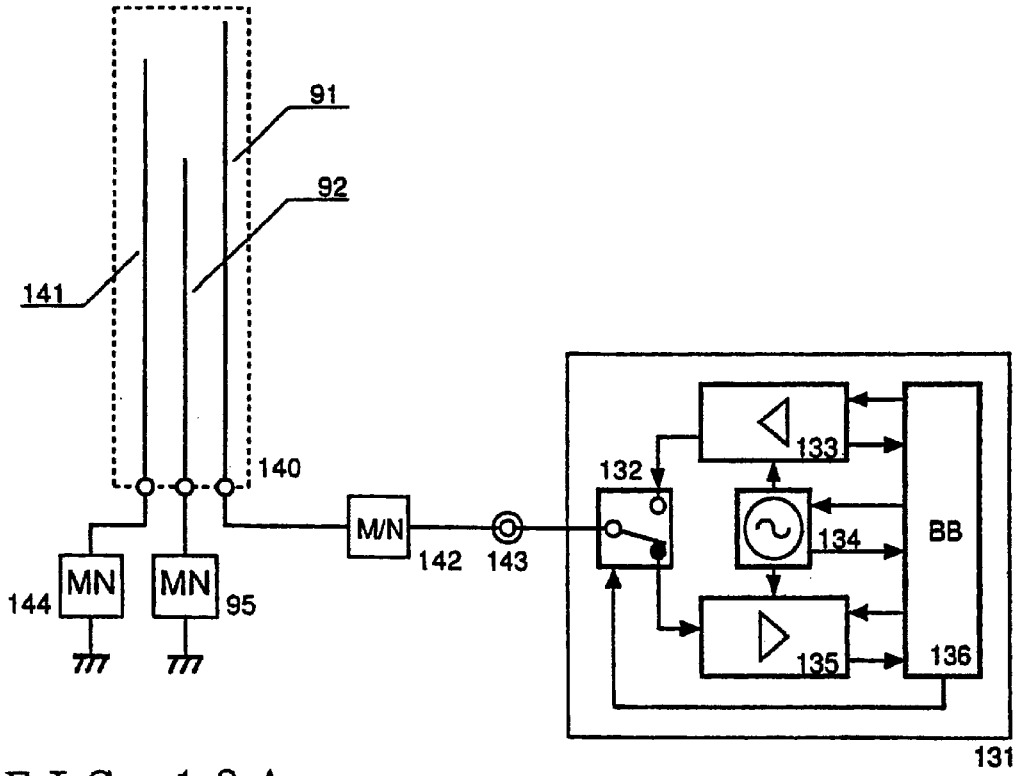
FIG. 12 is a block diagram showing an arrangement of a radio circuit, to which the antenna system of the third embodiment of the present invention is applied.

FIG. 12 is a block diagram showing an arrangement of a radio circuit, to which the antenna system of the third embodiment of the present invention is applied. The same component as in FIG. 10 and FIG. 11 is referred by the same symbol. By the above arrangement, it is possible to independently control impedance of the first frequency band A and the second frequency band B. As a result, in any of the first frequency band A and the second frequency band B, satisfactory matching condition can be attained, and mobile communication with high quality and stability can be achieved.

(4th Embodiment)

Figure 13A:
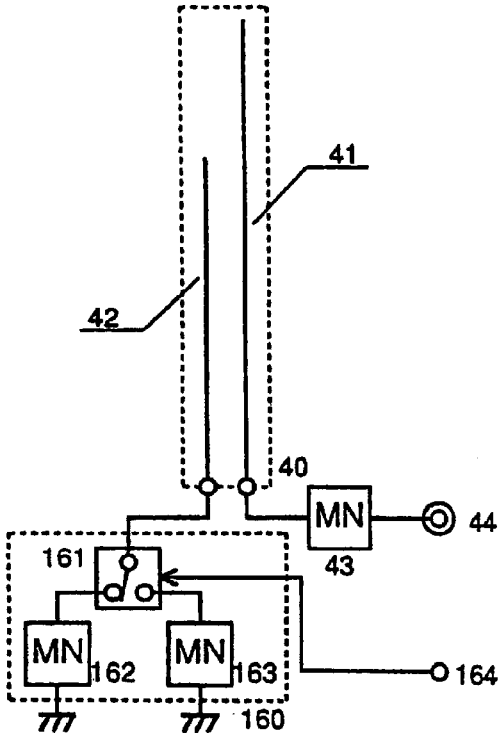
FIG. 13A and FIG. 13B each represents a block diagram showing an arrangement of an antenna system of a fourth embodiment of the present invention.
Figure 13B:
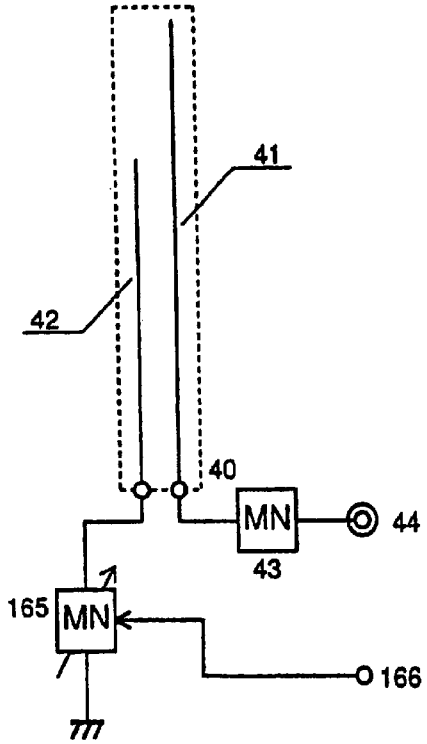

In the following, description will be given on an antenna system of a fourth embodiment of the present invention, referring to FIG. 13A to FIG. 15. FIG. 13A and FIG. 13B each represents an arrangement of the antenna system of the fourth embodiment of the present invention, where the antenna system of the fourth embodiment of the present invention is applied to a whip antenna. The same component as in FIG. 1 is referred by the same symbol.

FIG. 13A shows an arrangement example where impedance components are discretely controlled. A switch 161 switches over a terminating circuit 162 and a terminating circuit 163 having different impedance values according to a signal added to a control terminal 164.

FIG. 13B shows an arrangement example where impedance components are continuously controlled. Here, a terminating circuit 165 is a terminating circuit, which can continuously vary impedance, and it can be controlled by control voltage applied on a control terminal 166.

Figure 14A:
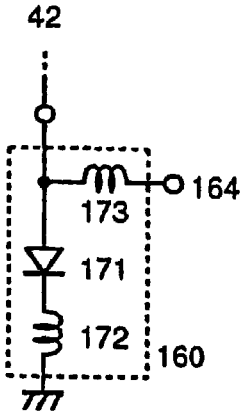
FIG. 14A and FIG. 14B each represents a concrete example of a terminal circuit used in the antenna system of the fourth embodiment of the present invention.
Figure 14B:
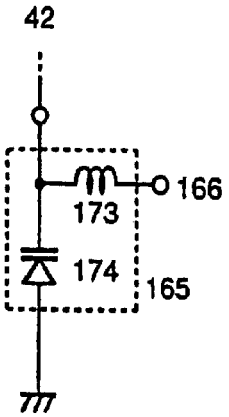

FIG. 14A and FIG. 14B each represents a diagram to explain arrangement and operation of the antenna system of the fourth embodiment of the present invention, and these diagrams show concrete arrangement examples of the (first) terminating circuit 160 of FIG. 13A and the (first) terminating circuit 165 of FIG. 13B. The same component as in FIG. 13A or FIG. 13B is referred by the same symbol.

FIG. 14 represents a concrete example of the (first) terminating circuit 160 having the function to discretely control the impedance. The (first) terminating circuit 160 comprises a PIN diode 171, an inductor 172, and an RFC 173, and it can have two types of impedance, i.e. inductive impedance and open-circuit impedance depending upon whether there is electric current flowing to the control terminal 164 or not.

FIG. 14B shows a concrete example of the (first) terminating circuit 165 having the function to continuously controlling impedance. The (first) terminating circuit 165 comprises a variable capacitance diode 174 and an RFC 173, and it can have capacitive impedance, which can be continuously controlled by voltage applied on the control terminal 166.

Figure 15:
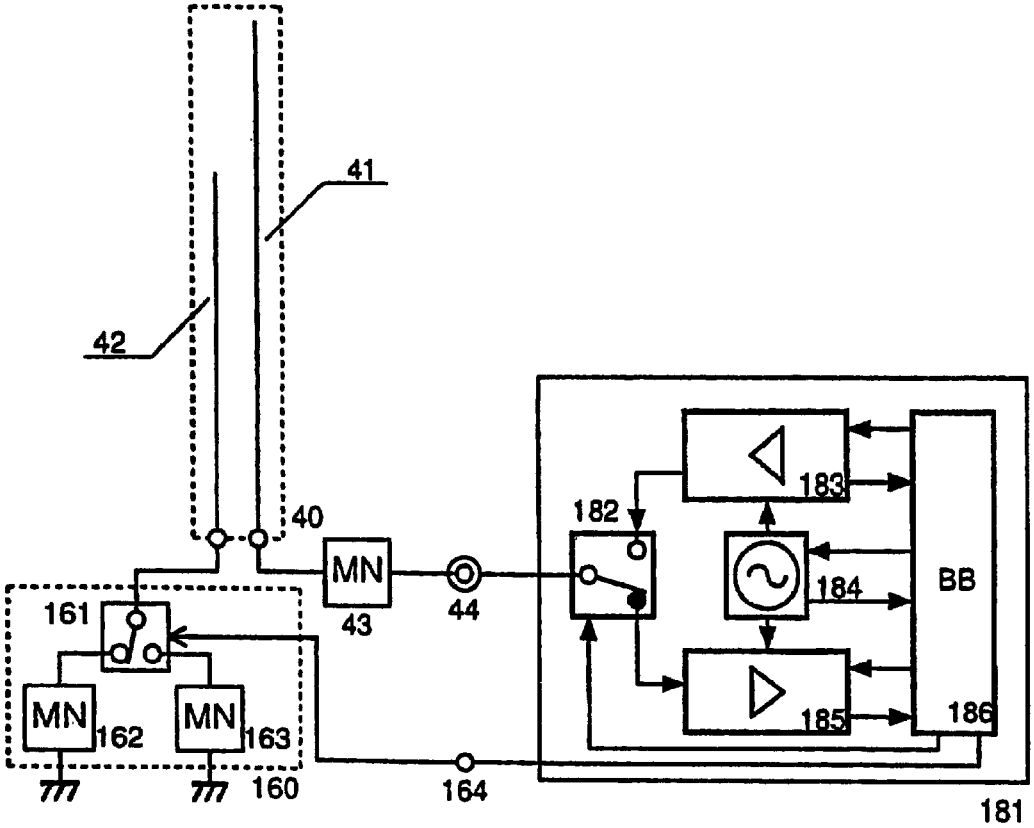
FIG. 15 is a block diagram showing an arrangement of a radio circuit, to which the antenna system of the fourth embodiment of the present invention is applied.

FIG. 15 shows an example of an arrangement of a wireless device, to which the antenna system shown in FIG. 13A (among the antenna system of the fourth embodiment of the present invention) is applied. The same component as in FIG. 5 and FIG. 13A is referred by the same symbol. Here, a radio circuit 181 comprises a switch 182, a transmitting circuit 183, an oscillation circuit 184, a receiving circuit 185, and a control circuit 186. With the above arrangement, impedance of the (first) terminating circuit 160 can be discretely controlled by a control signal from a control unit 186 of the radio circuit 181. As a result, it is possible to more precisely control impedance of the antenna element 41, and mobile communication with high quality and stability can be achieved.

(5th Embodiment)

Figure 16A:
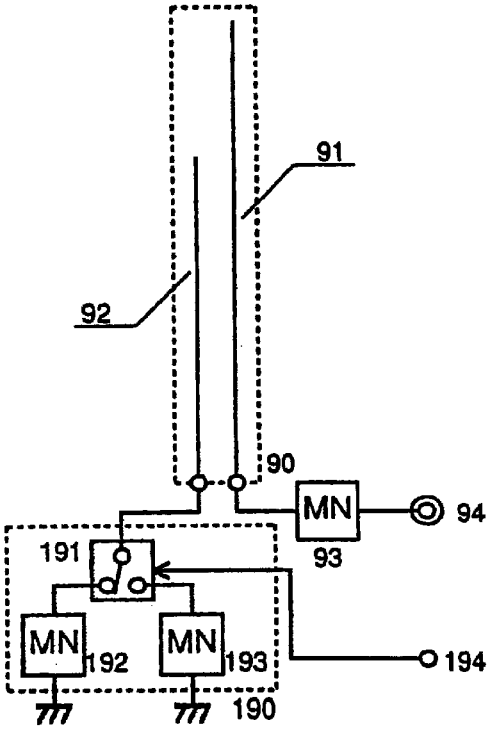
FIG. 16A and FIG. 16B each represents a block diagram of an antenna system of a fifth embodiment of the present invention.
Figure 16B:
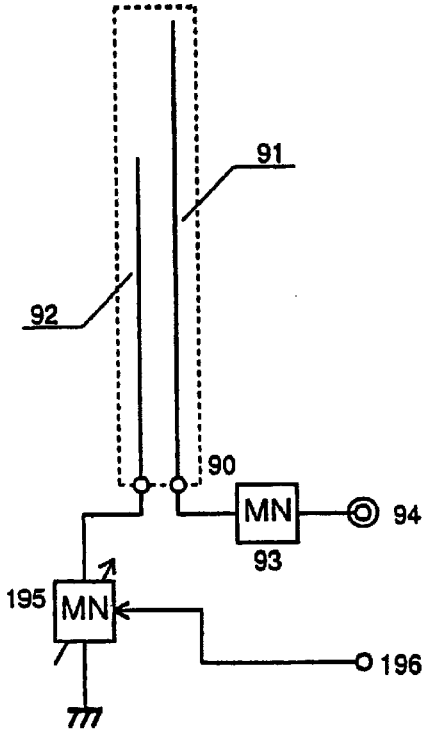

In the following, description will be given on an antenna of a fifth embodiment of the present invention referring to FIG. 16A and FIG. 16B. FIG. 16A and FIG. 16B each represents an arrangement of the antenna system of the fifth embodiment of the invention, where the antenna system of the fifth embodiment of the present invention is applied to a whip antenna. The same component as in FIG. 6 is referred by the same symbol.

FIG. 16A shows an arrangement example where impedance components are discretely controlled. Here, a switch 191 switches over a terminating circuit 192 and a terminating circuit 193 having different impedance values according to a signal added to a control terminal 194.

FIG. 16B shows an arrangement example where impedance components are continuously controlled. Here, a terminating circuit 195 is a terminating circuit, which can continuously vary the impedance, and it can be controlled by control voltage applied on a control terminal 196. A concrete example of the terminating circuit shown in FIG. 14 above can be applied to a (first) terminating circuit 190 and a (first) terminating circuit 195.

Figure 17:
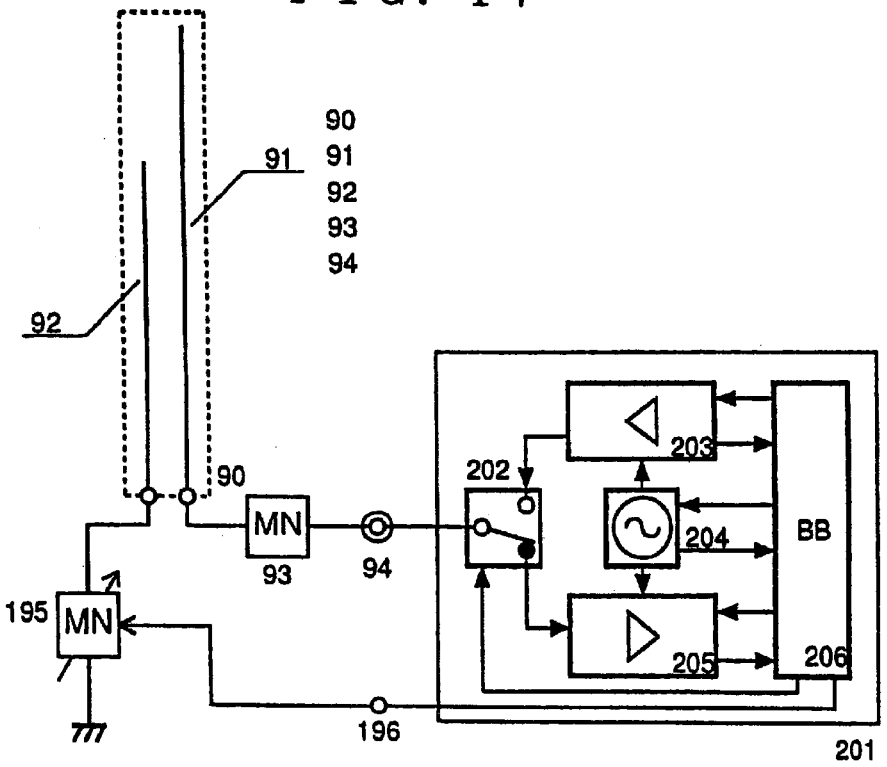
FIG. 17 is a block diagram showing an arrangement of a radio circuit, to which the antenna system of the fifth embodiment of the present invention is applied.

FIG. 17 represents an arrangement example of a wireless device, to which the antenna system of FIG. 16B (among the antenna system of the fifth embodiment of the invention) is applied. The same component as in FIG. 10 or FIG. 16B is referred by the same symbol. Here, a radio circuit 201 comprises a switch 202, a transmitting circuit 203, an oscillation circuit 204, a receiving circuit 205, and a control circuit 206. With the above arrangement, impedance of the (first) terminating circuit 195 can be controlled by a control signal from a control unit 206 of the radio circuit 201.

As a result, it is possible to precisely control impedance of the first frequency band A independently from impedance of the second frequency band B. As a result, in any of the first frequency band A and the second frequency band B, satisfactory matching condition can be attained, and mobile communication with high quality and stability can be achieved.

(6th Embodiment)

Figure 18:
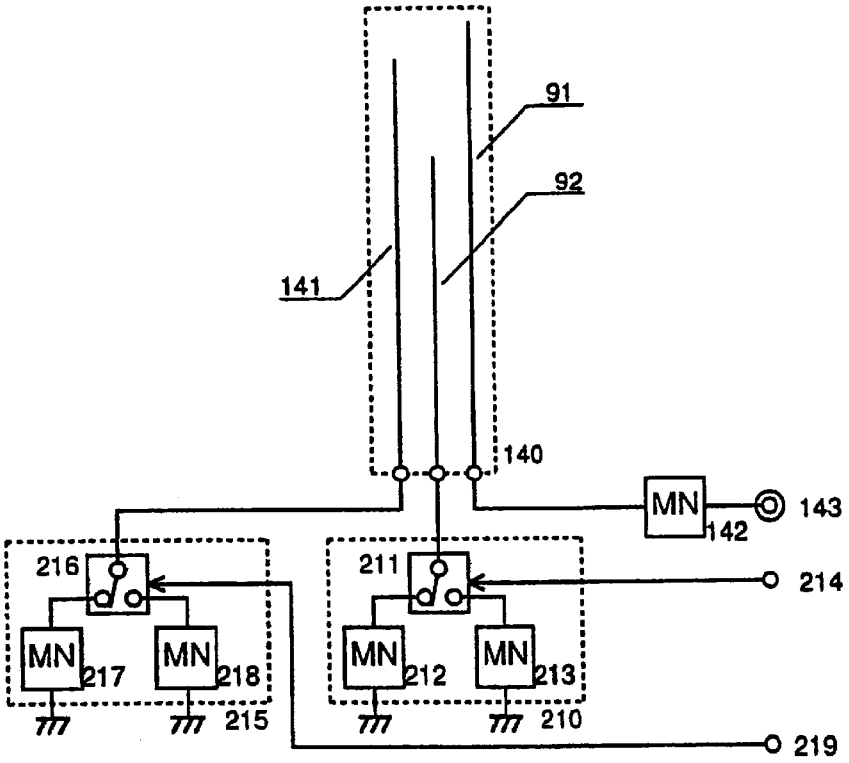
FIG. 18 is a block diagram showing an arrangement of an antenna system of a sixth embodiment of the present invention.

In the following, description will be given on an antenna system of a sixth embodiment of the present invention referring to FIG. 18 to FIG. 19. FIG. 18 is a block diagram to explain an arrangement of an antenna system of the sixth embodiment of the invention, where the antenna system of the sixth embodiment of the present invention is applied to a whip antenna. The same component as in FIG. 11 is referred by the same symbol.

FIG. 18 shows an arrangement example comprising a first terminating circuit 210 and a second terminating circuit 215 having the function to discretely control impedance components. Reference numerals 214 and 219 each represents a control terminal. By applying discrete signal to these terminals, it is possible to control impedance of the first terminating circuit 210 and the second terminating circuit 215. To the first terminating circuit 210 and the second terminating circuit 215C, concrete example of the terminating circuit of FIG. 14 can be applied. Either one or both of the first terminating circuit 210 and the second terminating circuit 215 may be designed in such manner that impedance components can be continuously controlled.

Figure 19:
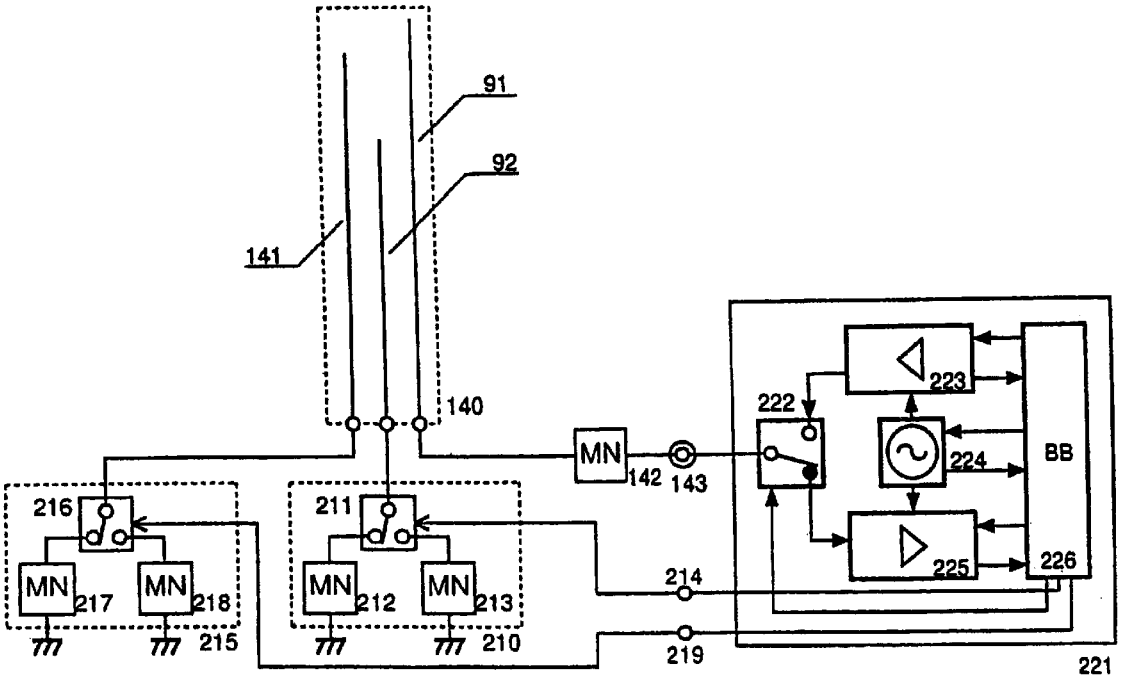
FIG. 19 is a block diagram showing an arrangement of a radio circuit, to which the antenna system of the sixth embodiment of the present invention is applied.

FIG. 19 represents an arrangement example of a radio circuit, to which the antenna system of the sixth embodiment is applied. The same component as in FIG. 12 or FIG. 18 is referred by the same symbol. Here, a radio circuit 221 comprises a switch 222, a transmitting circuit 223, an oscillation circuit 224, a receiving circuit 225, and a control circuit 226. With the above arrangement, it is possible to discretely control impedance of the first terminating circuit 210 or the second terminating circuit 215 according to a control signal from a control unit 226 of the radio circuit 221. As a result, in any of the first frequency band A and the second frequency band B, it is possible to precisely control impedance of the antenna element 91, and mobile communication with high quality and stability can be achieved.

(7th Embodiment)

Figure 20A:
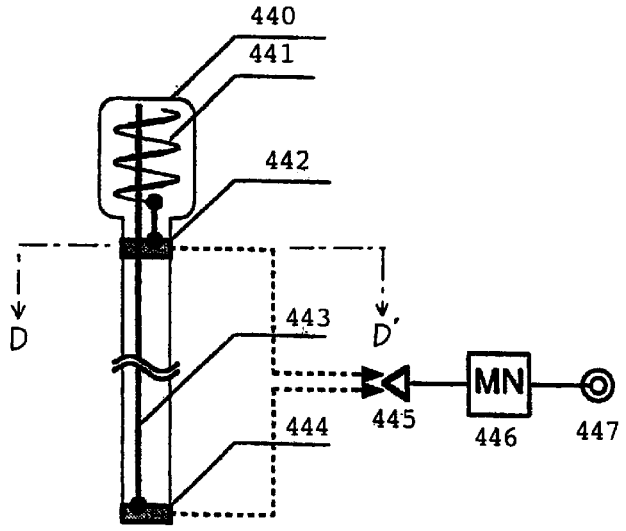
FIG. 20A to FIG. 20D each represents an arrangement of an antenna system of a seventh embodiment of the present invention.
Figure 20B:
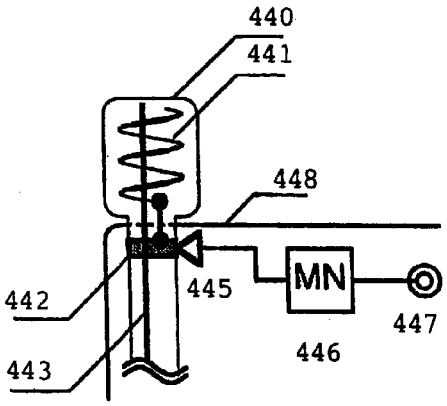
Figure 20C:
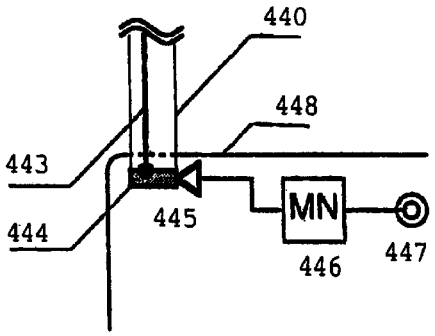
Figure 20D:
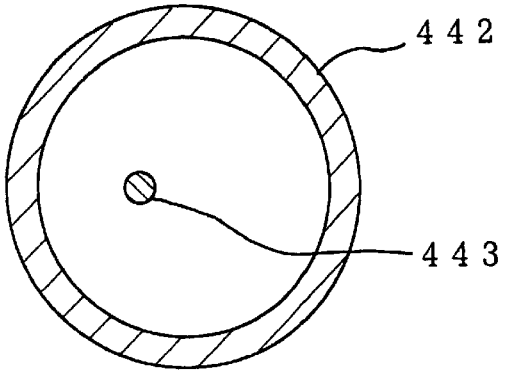

FIG. 20A to FIG. 20D are to explain the arrangement and operation of an antenna system of a seventh embodiment of the present invention. In this embodiment, the antenna system of the present invention is applied to an antenna, which can be accommodated in or withdrawn from a telephone set main unit. FIG. 20A shows an arrangement of an antenna system of the seventh embodiment of the invention, FIG. 20B shows the antenna when it is accommodated in the telephone set main unit, and FIG. 20C shows the antenna when it is withdrawn from the telephone set main unit. FIG. 20D is a cross-sectional view along the line D–D' in FIG. 20A. In the seventh embodiment and after, when there are helical and whip antennas, each of these is designed in a structure as shown in FIG. 20 so that the whip antenna is not brought into contact with the helical antenna and its feeding unit.

An antenna 440 comprises a helical antenna 441 having a ring-like feeding unit 442 (FIG. 20D) and a whip antenna 443 having a feeding unit 444. The antenna 440 has a casing shown by solid line, enclosing the helical antenna 441 and the whip antenna 443 in FIG. 20A. This i casing corresponds to the casing 40A shown by dotted line in FIG. 1 and may be designed as a container or a tube made of synthetic resin. The whip antenna 443 passes through inner space of the helical antenna 441, and the helical antenna 441 and the whip antenna 443 are electrically insulated from each other. When the antenna 440 is located in a telephone set main unit 448, the helical antenna 441 is connected to a connection terminal 447 leading to a radio circuit via a feeding unit 442, a connection member (terminal) 445, and a matching circuit 446 as shown in FIG. 20B. When the antenna 440 is withdrawn from the telephone set main unit 448, the whip antenna 443 is connected to a connection terminal 447 leading to the radio circuit via a feeding unit 444, the connection member 445 and the matching circuit 446.

Figure 21:
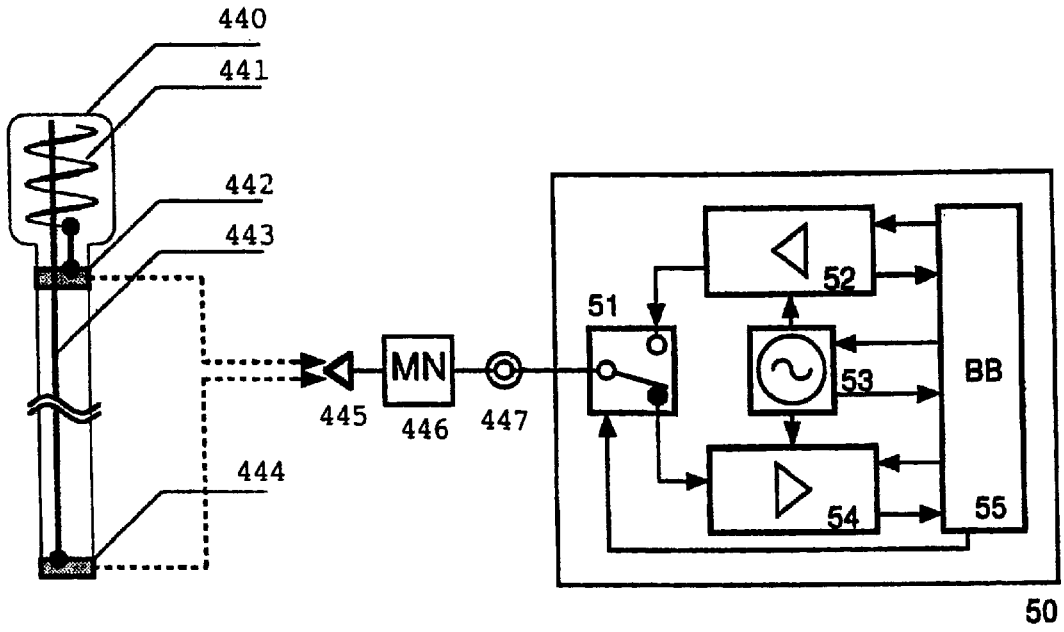
FIG. 21 shows an arrangement of a radio circuit, to which the antenna system of the seventh embodiment of the present invention is applied.

FIG. 21 is a block diagram to explain an arrangement of the antenna system of the seventh embodiment and shows an arrangement example of a wireless device provided with the antenna system of FIG. 20A. The same component as in FIG. 20A is referred by the same symbol.

Here, a radio circuit 50 comprises a switch 51, a transmitting circuit 52, an oscillation circuit 53, a receiving circuit 54, and a control circuit 55. By adopting such an arrangement, it is possible to avoid the increase of element length of the antenna 440 due to the helical antenna 441 and to maintain the strength of the connecting unit between the helical antenna 441 and the whip antenna 443.

(8th Embodiment)

Figure 22A:
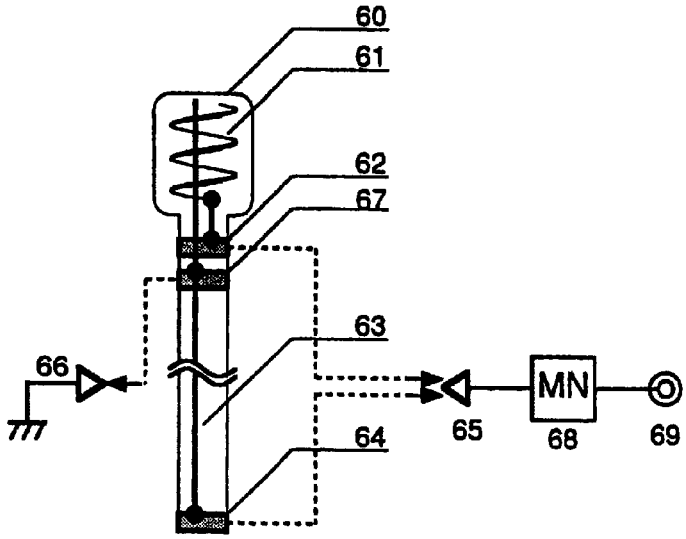
FIG. 22A to FIG. 22C each represents an arrangement of an antenna system of an eighth embodiment of the present invention.
Figure 22B:
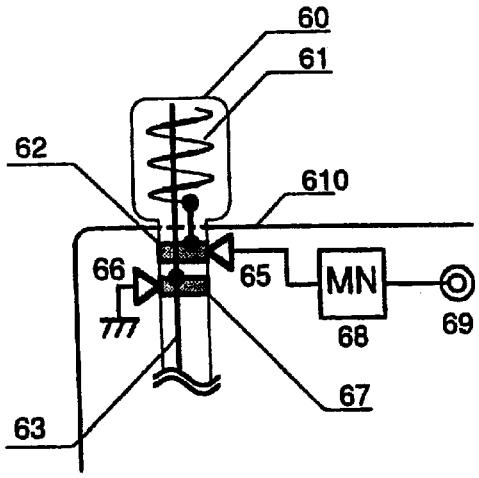
Figure 22C:
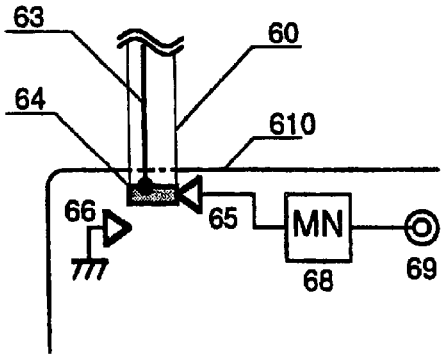

In the following, a description will be given on an arrangement of an antenna system of an eighth embodiment of the present invention referring to FIG. 22A to FIG. 24. FIG. 22A to FIG. 22C each represents a diagram to explain arrangement and operation of the antenna system of the eighth embodiment of the present invention. In this embodiment, the antenna system of the present invention is applied to an antenna, which can be accommodated in or withdrawn from a telephone set main unit. FIG. 22A shows an arrangement of the antenna system of the eighth embodiment of the present invention. FIG. 22B shows the antenna when it is located in the telephone set main unit, and FIG. 22C shows the antenna when it is withdrawn from the telephone set main unit.

An antenna 60 comprises a helical antenna 61 having a feeding unit 62 and a whip antenna 63 having a feeding unit 64 and a connecting unit 67 arranged closely to the feeding unit 62. The whip antenna 63 passes through the helical antenna 61, and the helical antenna 61 and the whip antenna 63 are electrically insulated from each other.

As shown in FIG. 22B, when the antenna is located in the telephone set main unit 610, the helical antenna 61 is connected to a connection terminal 69 leading to the radio circuit via the feeding unit, a connection member 65, and a matching circuit 68. The whip antenna 63 is short-circuited to a ground plane via a connecting unit 67 and a connection member 66. As shown in FIG. 22C, when the antenna 60 is withdrawn from the telephone set main unit 610, the whip antenna 63 is connected to the connection terminal 69 leading to the radio circuit via the feeding unit 64, the connection member 65, and the matching circuit 68.

Figure 23:
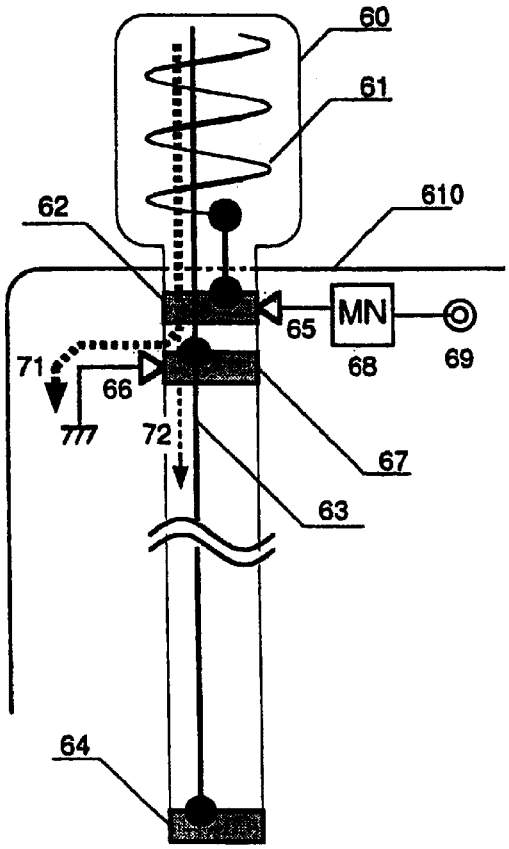
FIG. 23 is a drawing to explain operation of the antenna system of the eighth embodiment of the present invention.

FIG. 23 is to explain operation of the antenna system of the eighth embodiment of the present invention where the antenna 60 is accommodated in the telephone set main unit 610.

The same component as in FIG. 22A is referred by the same symbol. High frequency power supplied from the connection terminal 69 to the helical antenna 61 is induced on the whip antenna 63, a part of which passes through the helical antenna 61.

The high frequency current induced on the whip antenna 63 is divided at the connecting unit 67 to a current passage 71 leading from the connecting unit 67 via the connection member 66 to the ground plane and a current passage 72 leading along the whip antenna 63 to the feeding unit 64. Because the connection member 66 is short-circuited to the ground plane, high frequency current induced on the whip antenna 63 flows to the ground plane via the current passage 71, and almost no current flows along the current passage 72. For this reason, the radio circuit connected to the connection terminal 69 undergoes no influence from the telephone set main unit 610 or a person carrying it within the range from the connecting unit 67 to the feeding unit 64.

Figure 24:
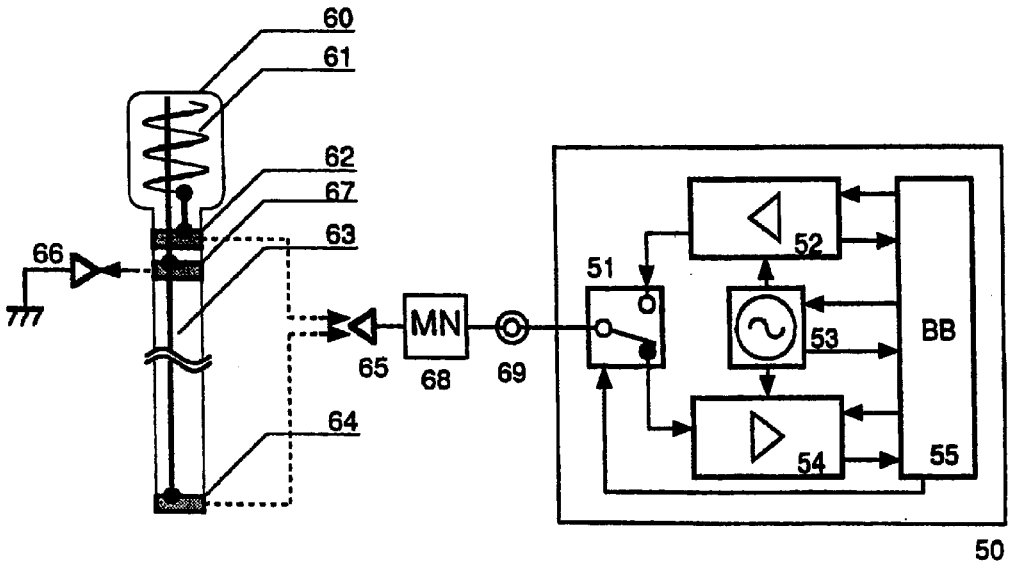
FIG. 24 shows an arrangement of a radio circuit, to which the antenna system of the eighth embodiment of the present invention is applied.

FIG. 24 shows an arrangement of the antenna system of the eighth embodiment of the present invention, and this is an arrangement example of a radio circuit provided with the antenna system of FIG. 22A. The same component as in FIG. 21 or FIG. 22A is referred by the same symbol. By adopting such an arrangement, it is possible to obtain an effect to hinder deterioration of characteristics when the antenna is accommodated in a telephone set main unit in addition to the effect of the antenna system of the seventh embodiment as described above.

(9th Embodiment)

Figure 25A:
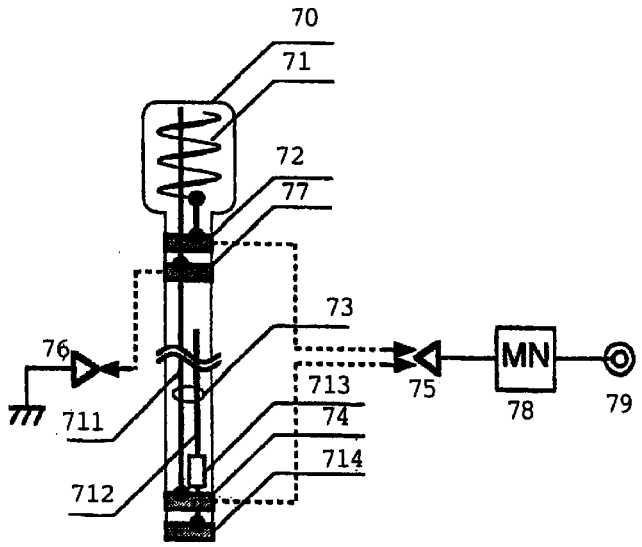
FIG. 25 to FIG. 25C each represents an arrangement of an antenna system of a ninth embodiment of the present invention.
Figure 25B:
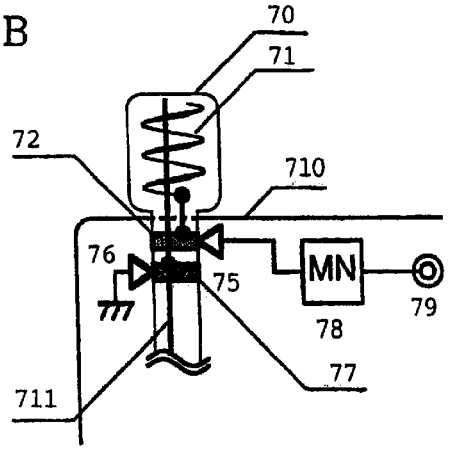
Figure 25C:
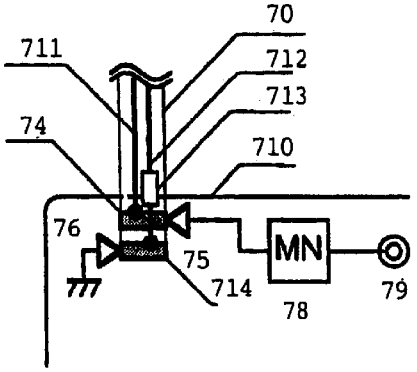

In the following, description will be given on an antenna system of a ninth embodiment of the present invention referring to FIG. 25A to FIG. 27. FIG. 25A to FIG. 25C are to explain arrangement and operation of the antenna system of the ninth embodiment of the present invention. In this embodiment, the antenna system of the present invention is applied to an antenna, which can be located in or withdrawn from a telephone set main unit. FIG. 25A represents an arrangement of the antenna system of the ninth embodiment of the present invention. FIG. 25B shows the antenna when it is located in the telephone set main unit, and FIG. 25C shows the antenna when it is withdrawn from the telephone set main unit. An antenna 70 comprises a helical antenna 71 having a feeding unit 72 and a whip antenna 73, which has a feeding unit 74, a connecting unit 77 arranged closely to the feeding unit 72, and a connecting unit 714 arranged closely to the feeding unit 74. The whip antenna 73 passes through the helical antenna 71, and the helical antenna 71 and the whip antenna 73 are electrically insulated from each other.

The whip antenna 73 comprises a radiation element 711, a parasitic element 712, and a terminating circuit 713. The radiation element 711 is electrically connected to the feeding unit 74 and the connecting unit 77. The parasitic element 712 is electrically connected to the connecting unit 714 via the terminating circuit 713.

As shown in FIG. 25B, when the antenna 70 is located in a telephone set main unit 710, the helical antenna 71 is connected to a connection terminal 79 leading to a radio circuit via the feeding unit 72, a connection member 75, and a matching circuit 78, and the radiation element 711 is short-circuited to a ground plane via the connecting unit 77 and a connection member 76.

As shown in FIG. 25C, when the antenna 70 is withdrawn from the telephone set main unit 710, the radiation element 711 is connected to the connection terminal 79 leading to the radio circuit via the feeding unit 74, the connection member 75, and the matching circuit 78, and the parasitic element 712 is short-circuited to the ground plane via the terminating circuit 713, the connecting unit 714, and the connection member 76.

Figure 26:
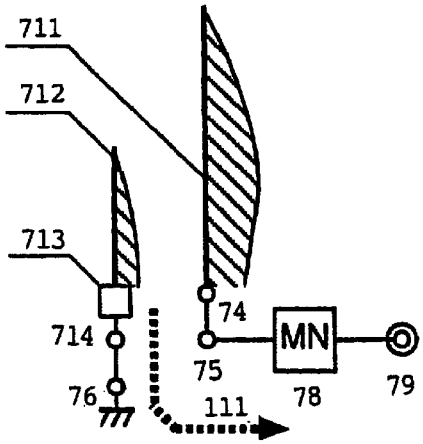
FIG. 26 is to explain operation of the antenna system of the ninth embodiment of the present invention.

FIG. 26 is to explain operation of the antenna system of the ninth embodiment of the present invention, and this shows current distribution of the radiation element 711 and the parasitic element 712 when high frequency power is supplied to the whip antenna 73 with the antenna 70 withdrawn from the telephone set main unit 710. Here, expansion on the shaded portion indicates values of electric current on elements of the radiation element 711 and the parasitic element 712. The same component as in FIG. 25A is referred by the same symbol.

A part of the high frequency power supplied to the radiation element 711 is induced on the parasitic element 712. If real equivalent electrical length of the parasitic element 712 is not ½ of the wavelength of the high frequency power supplied to the radiation element 711 or its integral multiple, the connecting point of the parasitic element 712 and the terminating circuit 713 is not a node of current distribution. For this reason, high frequency current 11 flows to the ground plane via the terminating circuit 713.

The high frequency current 11 flowing to the ground plane influences impedance of the radiation element 711. Because amplitude and phase of the high frequency current 111 can be controlled by impedance of the terminating circuit 713, by controlling impedance of the terminating circuit 713, it is possible to indirectly control impedance of the radiation element 711.

Figure 27:
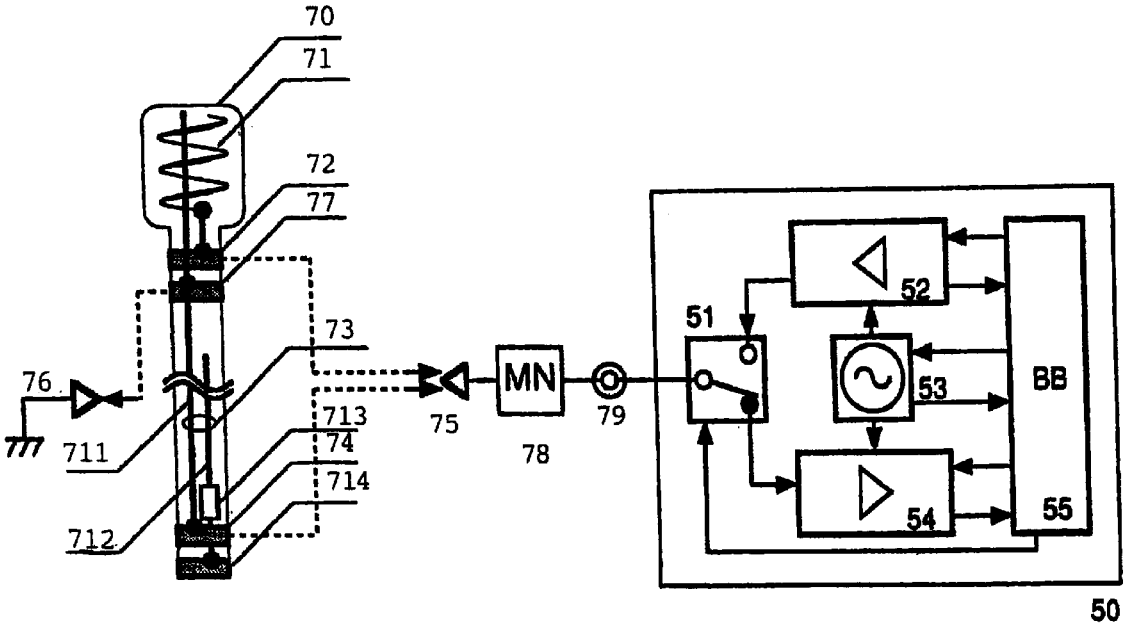
FIG. 27 shows an arrangement of a radio circuit, to which the antenna system of the ninth embodiment of the present invention is applied.

FIG. 27 is a diagram to explain an arrangement of an antenna system of the ninth embodiment of the present invention, and it shows an arrangement example of a radio circuit provided with the antenna system of FIG. 25A. The same component as in FIG. 21 or FIG. 22A is referred by the same symbol.

By adopting such an arrangement, it is possible, in addition to the effect of the antenna system of the eighth embodiment as described above, to control impedance of the radiation element by adjusting element length of the antenna and dimension of the radio circuit housing. As a result, a satisfactory matching condition can be attained, and mobile communication with high quality and stability can be achieved.

(10th Embodiment)

In the following, description will be given on an antenna system of a tenth embodiment of the present invention referring to FIG. 28A to FIG. 30.

Figure 28A:
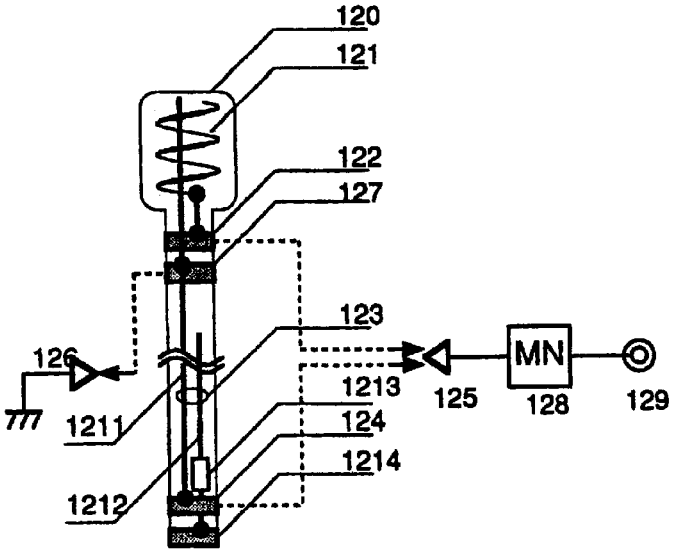
FIG. 28A to FIG. 28C each represents an arrangement of an antenna system of a tenth embodiment of the present invention.
Figure 28B:
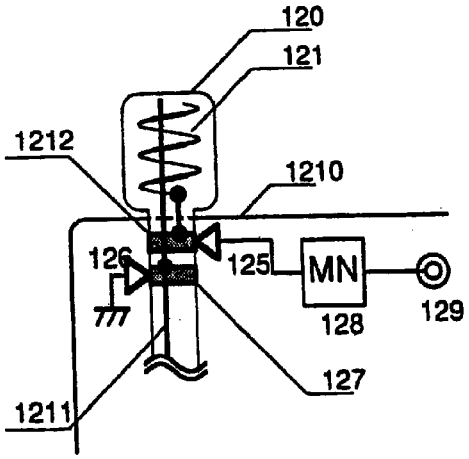
Figure 28C:
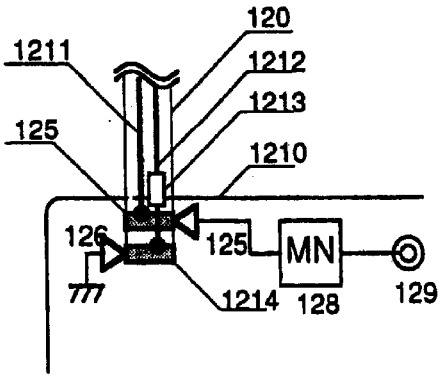

FIG. 28A is to explain arrangement and operation of the antenna system of the tenth embodiment of the present invention. In this embodiment, the antenna system of the present invention is applied to an antenna, which can be located in or withdrawn from a telephone set main unit. FIG. 28A shows an arrangement of the antenna system of the tenth embodiment of the present invention, and FIG. 28B shows the antenna when it is located in the telephone set main unit, while FIG. 28c shows the antenna when it is withdrawn.

In the description given below, the center frequency of the first frequency band A is fA and center frequency of the second frequency band B is assumed to be fB and that fA<fB, while the description is also applicable when it is assumed that fA>fB.

An antenna 120 comprises a helical antenna 121 having a feeding unit 122 and a whip antenna 123 having a feeding unit 124, a connecting unit 127 arranged closely to the feeding unit 122, and a connecting unit 1214 arranged closely to the feeding unit 124. The whip antenna 123 passes through the helical antenna 121, and the helical antenna 121 and the whip antenna 123 are electrically insulated from each other.

The whip antenna 123 comprises a radiation element 1211, a parasitic element 1212, and a terminating circuit 1213. The radiation element 1211 is electrically connected to the feeding unit 124 and the connecting unit 127. Also, the parasitic element 1212 is electrically connected to the connecting unit 1214 via the terminating circuit 1213.

Real equivalent electrical length of the parasitic element 1212 in the first frequency band A is not ½ wavelength or its integral multiple, and real equivalent electrical length in the second frequency band B is ½ wavelength or its integral multiple. As shown in FIG. 28B, when the antenna 120 is located in the telephone set main unit 1210, the helical antenna 121 is connected to a connection terminal 129 leading to a radio circuit via the feeding unit 122, a connection member 125, and a matching circuit 128, and the radiation element 1211 is short-circuited to a ground plane via the connecting unit 127 and the connection member 126.

As shown in FIG. 28C, when the antenna 120 is withdrawn from the telephone set main unit 1210, the radiation element 1211 is connected to the connection terminal 120 leading to the radio circuit via the feeding unit 124, the connection member 125, and the matching circuit 128, and the parasitic element 1212 is short-circuited to the ground plane via the terminating circuit 1213, the connecting unit 1214, and the connection member 126. Here, in the first frequency band A and the second frequency band B, the matching circuit 128 has double-humped characteristics to convert impedance of the helical antenna 121 and the whip antenna 123 to the desired impedance.

Figure 29A:
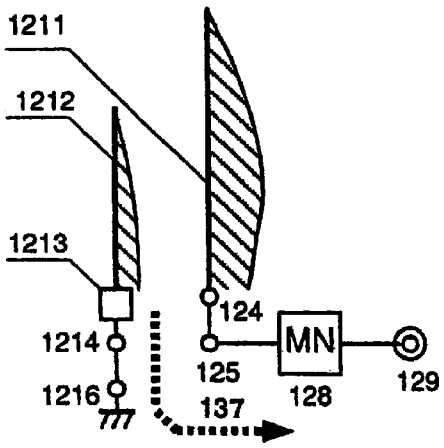
FIG. 29A and FIG. 29B each represents a drawing to explain operation of the antenna system of the tenth embodiment of the present invention.
Figure 29B:
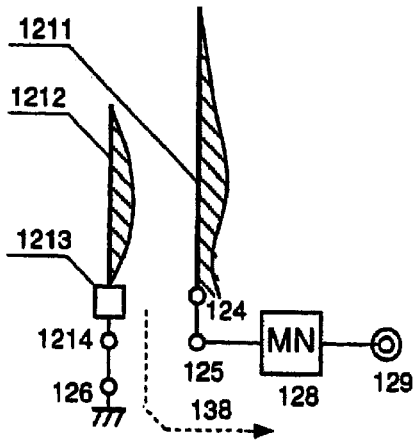

FIG. 29A and FIG. 29B are to explain operation of the antenna system of the tenth embodiment of the present invention, each showing current distribution of the radiation element 1211 and the parasitic element 1212 when high frequency power is supplied to the whip antenna 123 with the antenna 120 withdrawn from the telephone set main unit 1210. Expansion of the shaded portion indicates values of electric current on elements of the radiation element 1211 and the parasitic element 1212. The same component as in FIG. 28A is referred by the same symbol.

FIG. 29A shows current distribution of the radiation element 1211 and the parasitic element 1212 when high frequency power of the first frequency band A is supplied to the whip antenna 123. A part of the high frequency power of the first frequency band A supplied to the radiation element 1211 is induced on the parasitic element 1212. Real equivalent electrical length of the parasitic element 1212 is not ½ of wavelength of the first frequency band A or its integral multiple. For this reason, the connecting point of the parasitic element 1212 and the terminating circuit 1213 is not a node of current distribution, and high frequency current 137 flows to a ground plane via the terminating circuit 1213.

The high frequency current 137 flowing to the ground plane influences impedance of the radiation element 1211. Because amplitude and phase of the high frequency current 137 can be controlled by impedance of the terminating circuit 1213, it is possible to indirectly control impedance of the radiation element 1211 by controlling the impedance of the terminating circuit 1213.

FIG. 29B shows current distribution of the radiation element 1211 and the parasitic element 1212 when high frequency power of the second frequency band B is supplied to the whip antenna 123.

Similar to the description given in connection with FIG. 29A, a part of the high frequency power of the second frequency band B supplied to the radiation element 1211 is induced on the parasitic element 1212. With respect to the second frequency band B, real equivalent electrical length of the parasitic element 1212 is ½ of wavelength of the second frequency band B or its integral multiple, and the connecting point of the parasitic element 1212 and the terminating circuit 1213 is turned to a node in current distribution. For this reason, the high frequency current 138, which flows to the ground plane via the terminating circuit 1213 and does not depend on impedance of the terminating circuit 1213, has an extremely small value. Therefore, impedance of the radiation element 1211 in the second frequency band B has such a value that it can be determined by element length of the radiation element 1211 and physical dimension of the wireless device housing, and it undergoes almost no influence from impedance of the terminating circuit 1213.

Figure 30:
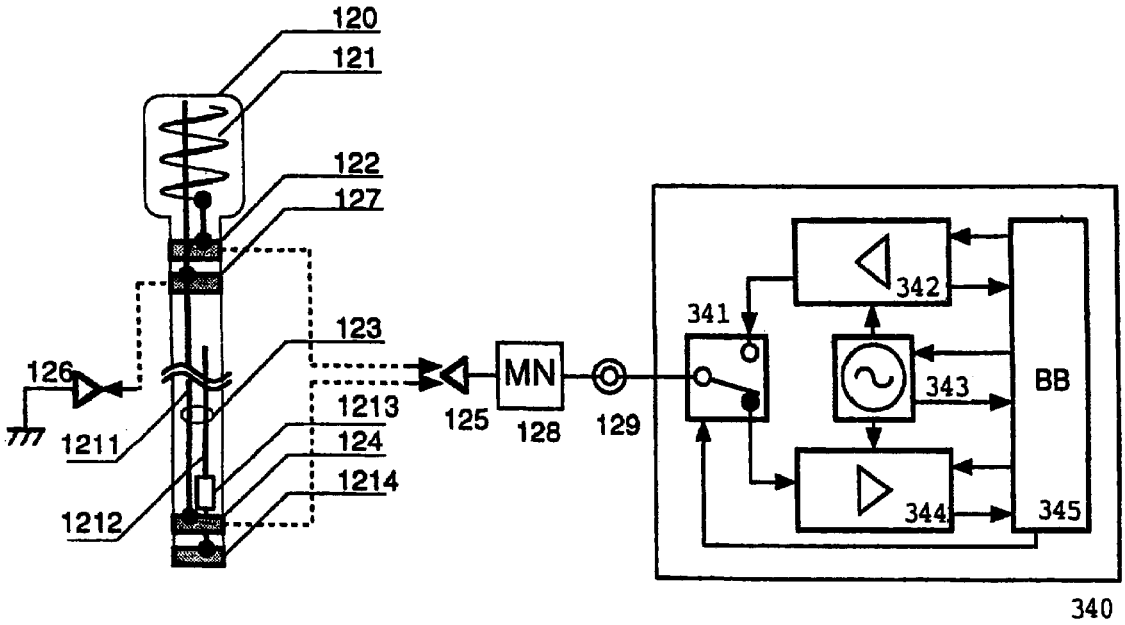
FIG. 30 shows an arrangement of a radio circuit, to which the antenna system of the tenth embodiment of the present invention is applied.

FIG. 30 is to explain an arrangement of the antenna system of the tenth embodiment of the present invention, showing an arrangement example of a radio circuit provided with the antenna system of FIG. 28A. The same component as in FIG. 28A is referred by the same symbol. Here, a radio circuit 340 is in charge of the first frequency band A and the second frequency band B, and it comprises a switch 341, a transmitting circuit 342, an oscillation circuit 343, a receiving circuit 344, and a control circuit 345.

By adopting such an arrangement, it is possible to control impedance of the first frequency band A independently from impedance of the second frequency band B. As a result, in any of the first frequency band A or the second frequency band B, satisfactory matching condition can be attained, and mobile communication with high quality and stability can be achieved.

(11th Embodiment)

Figure 31A:
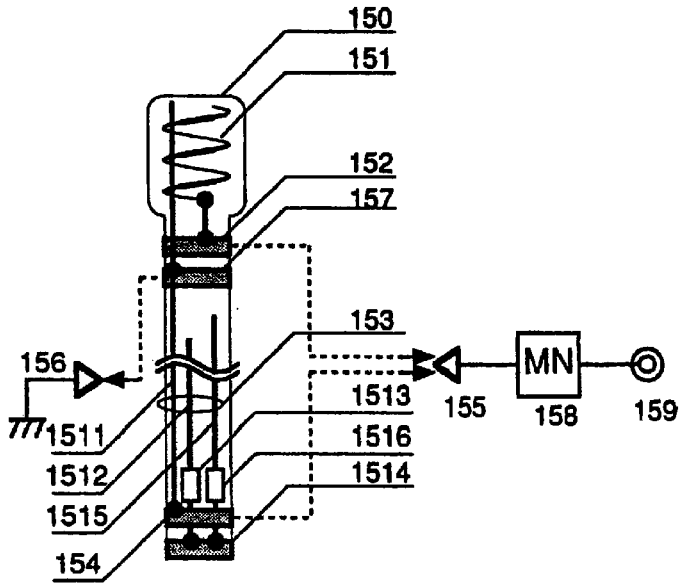
FIG. 31A to FIG. 31C each represents an arrangement of an antenna system of an eleventh embodiment of the present invention.
Figure 31B:
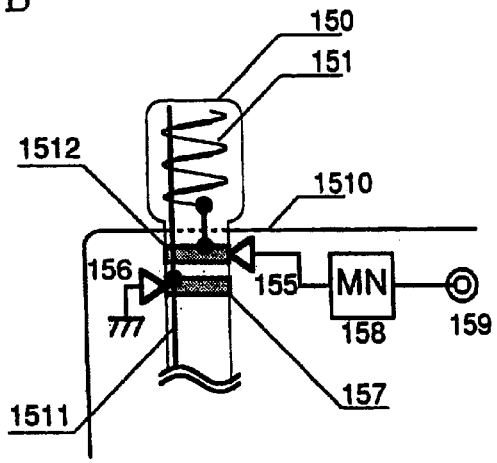
Figure 31C:
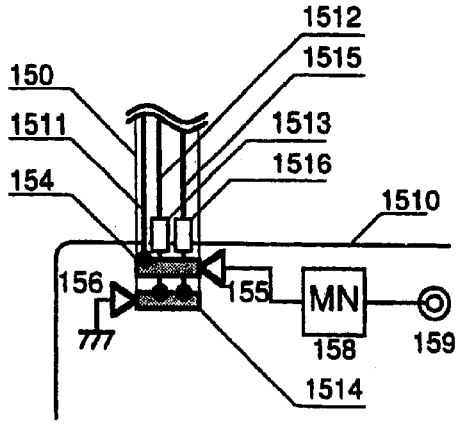

In the following, a description will be given on an a antenna system of an eleventh embodiment of the present invention referring to FIG. 31A to FIG. 31C and FIG. 32. FIG. 31A to FIG. 31C are to explain arrangement and operation of the antenna system of the eleventh embodiment of the present invention. In this embodiment, the antenna system of the present invention is applied to an antenna, which can be located in or withdrawn from a telephone set main unit. FIG. 31A shows an arrangement of the antenna system of the eleventh embodiment of the present invention, and FIG. 31B shows the antenna when it is locoted in the telephone set main unit, while FIG. 31C shows the antenna when it is withdrawn.

In the description given below, it is assumed that center frequency of the first frequency band A is fA and center frequency of the second frequency band B is fB and that fA<fB, while the description is also applicable when it is assumed that fA>fB. An antenna 150 comprises a helical antenna 151 having a feeding unit 152 and a whip antenna 153 having a feeding unit 154, a connecting unit arranged closely to the feeding unit 152, and a connecting unit 1514 arranged closely to the feeding unit 154. The whip antenna 153 passes through the helical antenna 151, and the helical antenna 151 and the whip antenna 153 are electrically insulated from each other.

The whip antenna 153 comprises a radiation element 1511, a first parasitic element 1512, a first terminating circuit 1513, a second parasitic element 1515, and a second terminating circuit 1516. The radiation element 1511 is electrically connected to the feeding unit 154 and the connecting unit 157. To the connecting unit 1514, the first parasitic element 1512 is connected via the first terminating circuit 1513, and the second parasitic element 1515 is connected via the second terminating circuit 1516. Real equivalent electrical length of the first parasitic element 1512 in the first frequency band A is not ½ wavelength or its integral multiple, and real equivalent electrical length in the second frequency band B is ½ wavelength or its integral multiple. Real equivalent electrical length of the second parasitic element 1515 in the first frequency band A is ½ wavelength or its integral multiple, and real equivalent electrical length in the second frequency band B is not ½ wavelength or its integral multiple.

As shown in FIG. 31B, when the antenna 150 is located in a telephone set main unit 1510, the helical antenna 151 is connected to a connection terminal 159 leading to a radio circuit via the feeding unit 152, a connection member 155, and a matching circuit 158, and the radiation element 1511 is short-circuited to a ground plane via the connecting unit 157 and the connection member 156.

As shown in FIG. 31C, when the antenna 150 is withdrawn from the telephone set main unit 1510, the radiation element 1511 is connected to the connection terminal 159 leading to the wireless device circuit via the feeding unit 154, the connection member 155, and the matching circuit 158. The first parasitic element 1512 is short-circuited to a ground plane via the first terminating circuit 1513, the connecting unit 1514, and the connection member 156, and the second parasitic element 1515 is short-circuited to the ground plane via the second terminating circuit 1516, the connecting unit 1514, and the connection member 156.

The matching circuit 158 has double-humped characteristics to convert impedance of the helical antenna 151 and the whip antenna 153 to the desired impedance in the first frequency band A and the second frequency band B. In the above arrangement, a part of the high frequency power supplied to the radiation element 1511 is induced on the first parasitic element 1512 and the second parasitic element 1515.

In the first frequency band A, the connecting point of the first parasitic element 1512 and the first terminating circuit 1513 is not a node of current distribution, and high frequency current flows to the ground plane via the first terminating circuit 1513, the connecting unit 1514, and the connection member 156. Impedance of the radiation element 1511 undergoes influence from the high frequency current flowing to the ground plane. Because amplitude and phase of the high frequency current can be controlled by impedance of the first terminating circuit 1513, it is possible to indirectly control impedance of the first frequency band A of the radiation element 1511 by controlling impedance of the first terminating circuit 1513.

In the first frequency band A, the connecting point of the second parasitic element 1515 and the second terminating circuit 1516 is a node of current distribution, and the high frequency current is extremely low, which flows to the ground plane via the second terminating circuit 1516, the connecting unit 1514, and the connection member 156 without depending on impedance of the second terminating circuit 1516, and very little influence is exerted on the impedance of the radiation element 1511.

In the second frequency band B, the connecting point of the first parasitic element 1512 and the first terminating circuit 1513 is a node of current distribution. Thus, the high frequency current is extremely low, which flows to the ground plane via the first terminating circuit 1513, the connecting unit 1514, and the connection member 156, and very little influence is exerted on impedance of the radiation element 1511. In the second frequency band B, the connecting point of the second parasitic element 1515 and the second terminating circuit 1516 is not a node of current distribution, and the high frequency current flows to the ground plane via the second terminating circuit 1516, the connecting unit 1514, and the connection member 156.

Impedance of the radiation element 1511 undergoes influence from the high frequency current flowing to the ground plane. Because amplitude and phase of the high frequency current can be controlled by impedance of the second terminating circuit 1516, it is possible to indirectly control impedance of the second frequency band B of the radiation element 1511 by controlling impedance of the second terminating circuit 1516.

Figure 32:
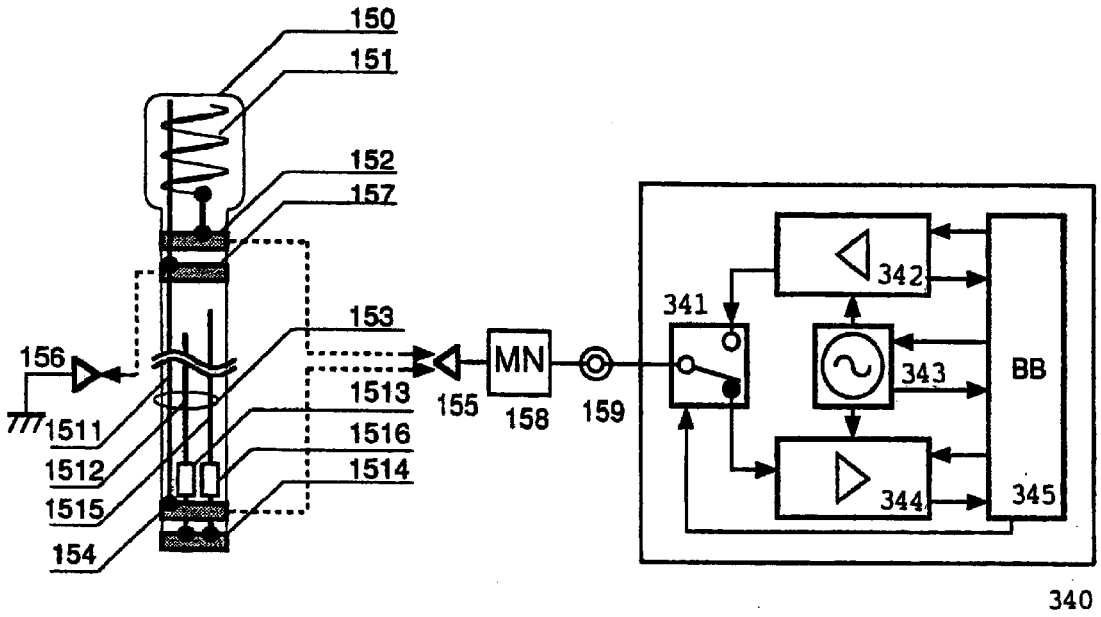
FIG. 32 shows an arrangement of a radio circuit, to which the antenna system of the eleventh embodiment of the present invention is applied.
Figure 33:
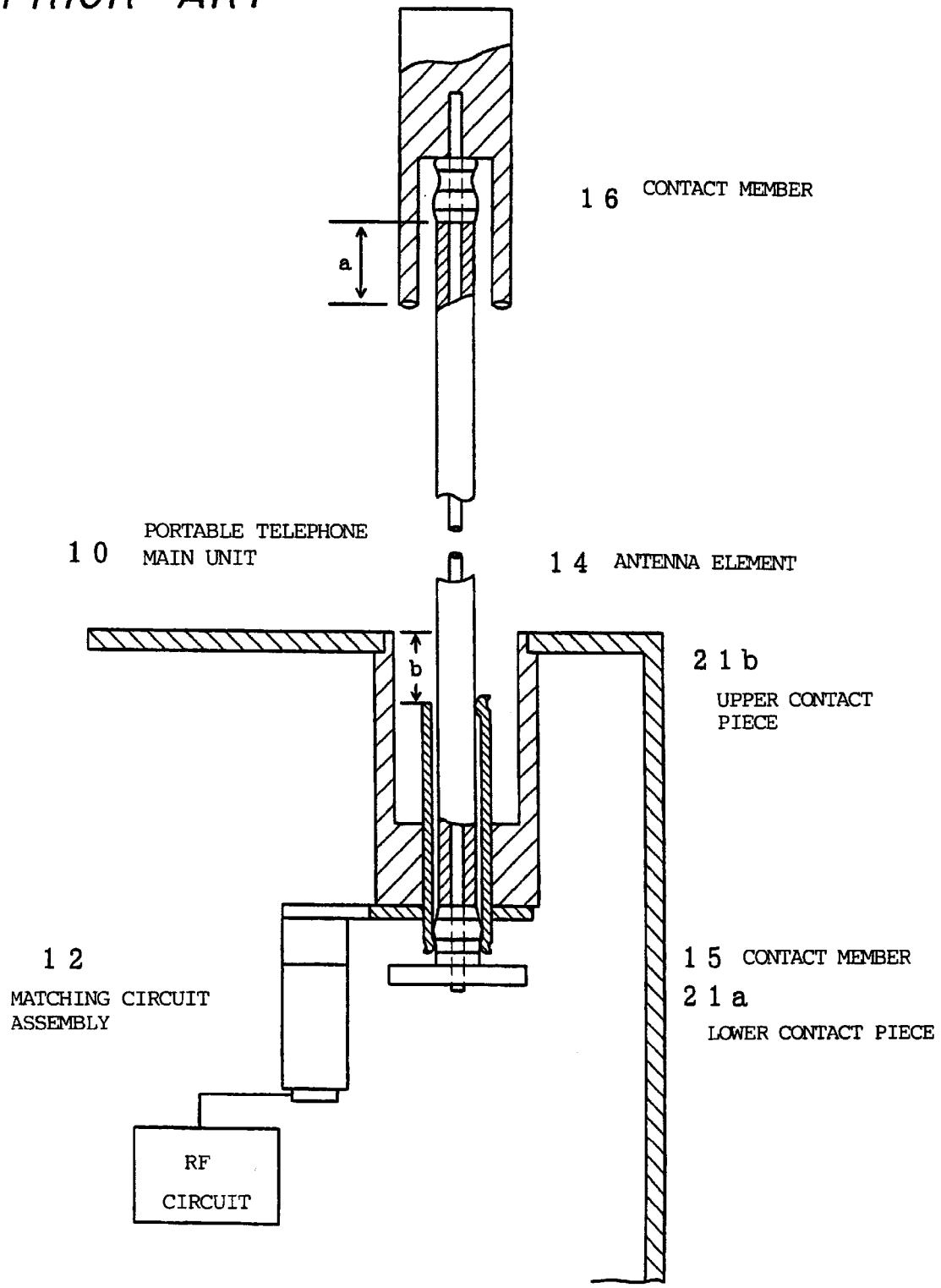
FIG. 33 PRIOR ART
FIG. 33 shows an arrangement of a conventional type antenna system when an antenna element is withdrawn.
Figure 34:
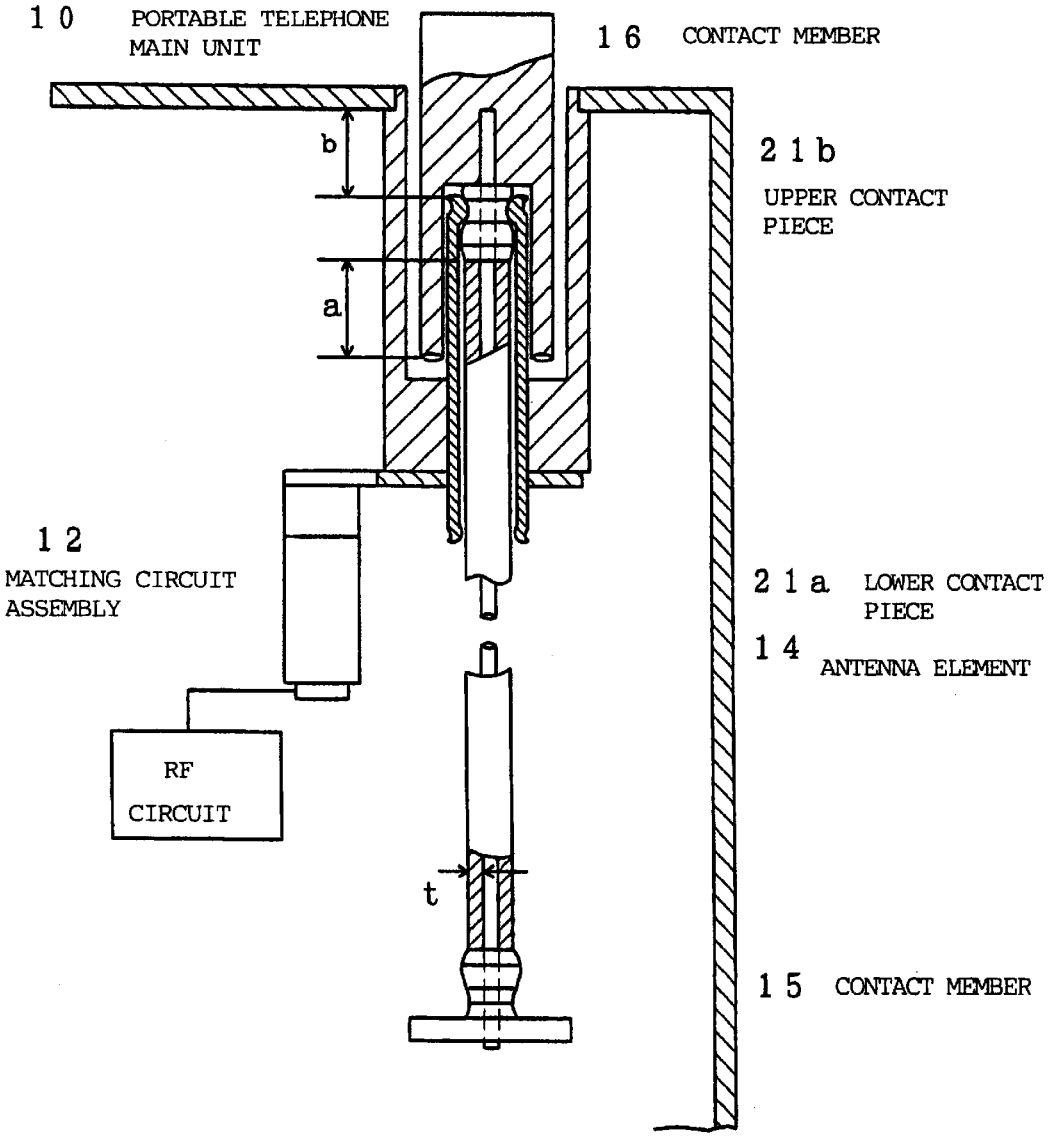
FIG. 34 PRIOR ART
FIG. 34 shows an arrangement of the conventional type antenna system when the antenna element is located in the system.
Figure 35A:
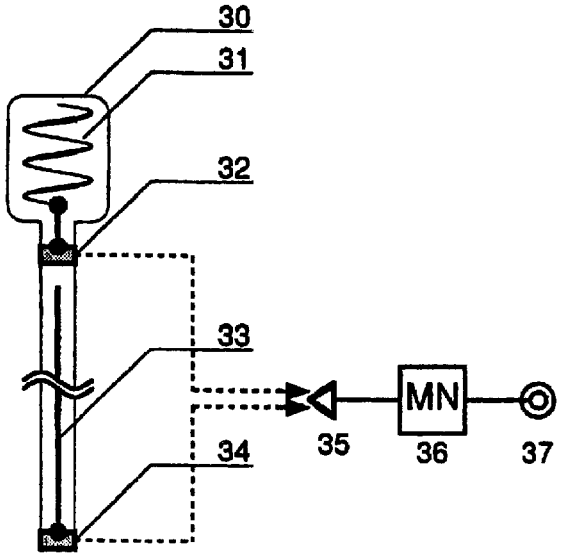
FIG. 35A PRIOR ART
FIG. 35A to FIG. 35C each represents an arrangement of a conventional separate type helical-whip antenna.
Figure 35B:
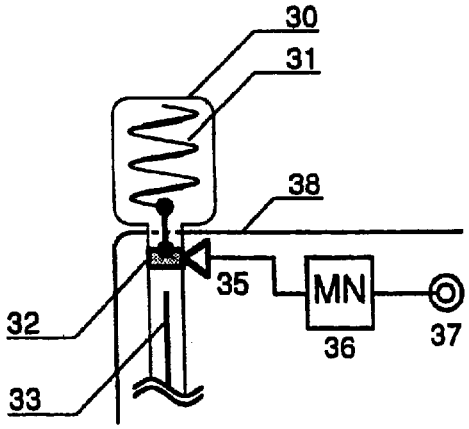
FIG. 35B PRIOR ART
Figure 35C:
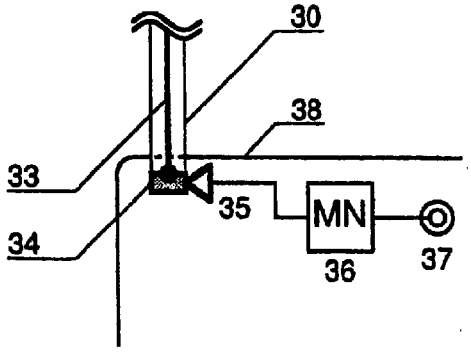
FIG. 35C PRIOR ART

FIG. 32 is to explain an arrangement of the antenna system of the eleventh embodiment of the present invention, and it represents an arrangement example of a radio circuit provided with the antenna system of FIG. 31A. The same component as in FIG. 30 and FIG. 31A is referred by the same symbol. By adopting such an arrangement, it is possible to control impedance of the first frequency band A or the second frequency band B independently from each other. As a result, in any of the first frequency band A and the second frequency band B, a satisfactory matching condition can be attained, and mobile communication with high quality and stability can be achieved.

INDUSTRIAL APPLICABILITY

As described above, it is possible according to the present invention, in an antenna which is used for a mobile radio circuit and which can be accommodated in or withdrawn from a telephone set main unit, to shorten element length and to increase strength while avoiding deterioration of characteristics when the antenna is located in the telephone set main unit, and also to add the function of controlling impedance of the whip antenna. As a result, a satisfactory matching condition can be attained, and mobile communication with high quality and stability can be achieved.

Also, the above impedance control function can be independently fulfilled-in the two frequency bands. Accordingly, satisfactory matching can be attained in the two frequency bands in a wireless system using two types of frequency, and mobile communication with high quality and stability can be achieved.

What is claimed is:

1. A nondirectional antenna system comprising:

an antenna element connected to a radio circuit having a first frequency band, and a first parasitic element;

said first parasitic element located at a distance from the antenna element that is less than the wavelength of frequencies within the first frequency band, the distance being sufficiently small to achieve nondirectivity;

a real equivalent electrical length of said first parasitic element in said first frequency band is not ½ wavelength or its integral multiple and is terminated by a first terminating circuit comprising a reactance element that varies the electrical length of the parasitic element.

2. An antenna system according to claim 1, wherein:

said antenna element is connected to a radio circuit having said first frequency band and a second frequency band;

said first parasitic element located at a distance from the antenna element that is less than the wavelength of frequencies within the first and second frequency bands, the distance being sufficiently small to achieve non-directivity; a real equivalent electrical length of said first parasitic element in said second frequency band is ½ wavelength or its integral multiple.

3. An antenna system according to claim 2, wherein there is provided a second parasitic element, and further wherein:

said second parasitic element is located at a distance from the antenna element and said first parasitic element that is less than the wavelength of frequencies within the first and second frequency bands, the distance being sufficiently small to achieve non-directivity;

real equivalent electrical length of said second parasitic element in said first frequency band is ½ wavelength or its integral multiple; and real equivalent electrical length of said second parasitic element in said second frequency band is not ½ wavelength or its integral multiple, and said second parasitic element is terminated by a second terminating circuit having a reactance element.

4. An antenna system according to claim 1, wherein said first terminating circuit is selectable to discretely or continuously control the impedance of the antenna element.

5. An antenna system according to claim 2, wherein said first terminating circuit is selectable to discretely or continuously control the impedance of the element.

6. An antenna system according to claim 3, wherein at least one of said first terminating circuit or said second terminating circuit is selectable to discretely or continuously control the impedance of the antenna element.

7. A non directional antenna system comprising:

an antenna casing movable between first and second positions with respect to a radio circuit main unit including a radio circuit, said antenna casing having a helical antenna operated when said antenna casing is located at said first position so that a major portion of said antenna casing is received in said radio circuit main unit, and a whip antenna to be operated when the antenna casing is located at said second position so that a major portion of said antenna casing is outside of the radio circuit main unit, said helical antenna and said whip antenna being electrically insulated from each other, and said whip antenna being designed to pass through said helical antenna, said helical antenna being positioned at one end of said antenna casing, said antenna casing having a first connecting unit for connecting said helical antenna to said radio circuit when said antenna casing is located at said first position, a second connecting unit for connecting said whip antenna to a ground plane when said antenna casing is located at said first position and a third connecting unit for connecting said whip antenna to said radio circuit when said antenna casing is located at said second position, said second connecting unit being located directly below said first connecting unit, and said third connecting unit being located apart from said first and second connecting units such that said third connecting unit is close to the other end of said antenna casing.

8. A non-directional antenna system comprising:

a helical antenna operated when an antenna is located in a radio circuit main unit, and a whip antenna to be operated when the antenna is withdrawn from the radio circuit main unit, said helical antenna and said whip antenna are electrically insulated from each other, and said whip antenna is designed to pass through said helical antenna;

wherein said helical antenna has a connecting unit to be connected to a radio circuit when the antenna is located in the radio circuit main unit containing said radio circuit, said whip antenna is arranged closely to said connecting unit and has a first connecting unit to be connected to a ground plane when the antenna is located in the radio circuit main unit and a second connecting unit to be connected to the radio circuit when the antenna is drawn out from the main unit, said first connecting unit being located directly below said connecting unit of said helical antenna;

and further wherein there is provided a parasitic element located at a distance from the whip antenna that is less than the wavelength of the frequency band applied, and said parasitic element has a connecting unit to be connected to a ground plane via a circuit network comprising a reactance element when said whip antenna is withdrawn from the wireless device main unit.

9. An antenna system according to claim 8, wherein said helical antenna and said whip antenna are connected to a radio circuit having a first frequency band and a second frequency band applied, said parasitic element is located at a distance from the whip antenna that is less than the wavelength of frequencies within the first and second frequency bands, real equivalent electrical length of said parasitic element in said first frequency band is not ½ wavelength or its integral multiple, and real equivalent electrical length of said parasitic element in said second frequency band is ½ wavelength or its integral multiple.

10. An antenna system according to claim 9, wherein there is further provided a second parasitic element, said second parasitic element is located at a distance from the whip antenna and said first parasitic element that is less than the wavelength of frequencies within the first and second frequency bands, real equivalent electrical length of said second parasitic element in said first frequency band is ½ wavelength or its integral multiple, and real equivalent electrical length of said second parasitic element in said second frequency band is not ½ wavelength or its integral multiple, and said second parasitic element is connected to a connecting unit via a circuit network comprising a reactance element.

* * * * *